US011587425B1

(12) United States Patent
Volkerink et al.

(10) Patent No.: US 11,587,425 B1
(45) Date of Patent: Feb. 21, 2023

(54) NEXT GENERATION BUILDING ACCESS CONTROL, INDOOR LOCATIONING, AND INTERACTION TRACKING

(71) Applicant: Trackonomy Systems, Inc., San Jose, CA (US)

(72) Inventors: Hendrik J Volkerink, Palo Alto, CA (US); Ajay Khoche, West San Jose, CA (US)

( * ) Notice: Subject to any disclaimer, the term of this patent is extended or adjusted under 35 U.S.C. 154(b) by 0 days.

(21) Appl. No.: 17/323,995

(22) Filed: May 18, 2021

Related U.S. Application Data

(60) Provisional application No. 63/087,304, filed on Oct. 5, 2020, provisional application No. 63/026,722, filed on May 18, 2020, provisional application No. 63/026,067, filed on May 17, 2020.

(51) Int. Cl.
*G08B 21/12* (2006.01)

(52) U.S. Cl.
CPC ..... *G08B 21/12* (2013.01)

(58) Field of Classification Search
CPC ..... G08B 21/12
See application file for complete search history.

(56) References Cited

U.S. PATENT DOCUMENTS

| | | | |
|---|---|---|---|
| 5,495,250 | A | 2/1996 | Ghaem et al. |
| 6,375,780 | B1 | 4/2002 | Tuttle et al. |
| 6,614,392 | B2 | 9/2003 | Howard |
| 7,048,194 | B2 | 5/2006 | Minami et al. |
| 7,177,054 | B2 | 2/2007 | Silverbrook et al. |
| 7,299,990 | B2 | 11/2007 | Hoshina |
| 7,405,656 | B2 | 7/2008 | Olsen |
| 7,511,616 | B2 | 3/2009 | Lake |
| 7,540,603 | B2 | 6/2009 | Otsuki |
| 7,743,984 | B2 | 6/2010 | Olsen et al. |
| 7,838,844 | B2 | 11/2010 | Wagner et al. |
| 8,016,194 | B2 | 9/2011 | Hause et al. |
| 8,072,620 | B2 | 12/2011 | Yamamoto et al. |
| 8,171,791 | B2 | 5/2012 | Sy et al. |
| 8,292,173 | B2 | 10/2012 | Yturralde et al. |

(Continued)

FOREIGN PATENT DOCUMENTS

| | | | |
|---|---|---|---|
| JP | 2008239282 | A | 10/2008 |
| JP | 2011090670 | A | 5/2011 |
| JP | 2012141995 | A | 7/2012 |

OTHER PUBLICATIONS

International Patent Application No. PCT/2020/061394, International Search Report and Written Opinion dated Feb. 26, 2021, 16 pages.

(Continued)

*Primary Examiner* — Travis R Hunnings

(57) ABSTRACT

A wireless tracking system comprises a plurality of tape nodes associated with entities in an environment. The entities may comprise, for example, users, machinery, ingress and egress points of the environment. The tape nodes are configured to detect interactions that occur within the environment. Interactions may be defined based on one or more conditions, such as threshold durations or proximities between tape nodes. Interactions are stored by the tape nodes, uploaded to the wireless tracking system, and may be retrieved at a later time responsive to an event occurring, such as suspected contamination or incorrect use of machinery.

20 Claims, 19 Drawing Sheets

(56) References Cited

U.S. PATENT DOCUMENTS

| | | | | |
|---|---|---|---|---|
| 8,317,230 | B2 | 11/2012 | Asay | |
| 8,581,701 | B2 | 11/2013 | Steinmetz et al. | |
| 8,686,685 | B2 | 4/2014 | Moshfeghi | |
| 8,833,664 | B2 | 9/2014 | Choi | |
| 9,251,459 | B2 | 2/2016 | Simske et al. | |
| 9,305,283 | B1 | 4/2016 | Lauka et al. | |
| 9,643,460 | B2 | 5/2017 | Peine et al. | |
| 9,644,401 | B2 | 5/2017 | Nguyen et al. | |
| 10,095,898 | B2 | 10/2018 | Iqbal et al. | |
| 10,819,137 | B2 | 10/2020 | Khoche et al. | |
| 2004/0044493 | A1 | 3/2004 | Coulthard | |
| 2005/0099292 | A1 | 5/2005 | Sajkowsky | |
| 2007/0049291 | A1 | 3/2007 | Kim et al. | |
| 2007/0287473 | A1 | 8/2007 | Dupray | |
| 2008/0198002 | A1 | 8/2008 | Bartholf et al. | |
| 2008/0198022 | A1 | 8/2008 | Battles et al. | |
| 2009/0174600 | A1 | 7/2009 | Mazlum et al. | |
| 2009/0192709 | A1 | 7/2009 | Yonker et al. | |
| 2010/0089803 | A1* | 4/2010 | Lavi | B07C 5/3412 209/552 |
| 2011/0062237 | A1 | 3/2011 | Chaves | |
| 2011/0139871 | A1 | 6/2011 | Yturralde et al. | |
| 2012/0256728 | A1 | 10/2012 | Bajic et al. | |
| 2012/0278676 | A1 | 11/2012 | Teraura | |
| 2013/0250357 | A1 | 9/2013 | Yu | |
| 2014/0159869 | A1 | 6/2014 | Zumsteg et al. | |
| 2014/0240088 | A1 | 8/2014 | Robinette et al. | |
| 2014/0263634 | A1* | 9/2014 | Iqbal | G16H 40/20 235/385 |
| 2015/0097674 | A1* | 4/2015 | Mondal | H04W 4/029 340/572.1 |
| 2015/0349667 | A1 | 12/2015 | Andosca et al. | |
| 2016/0011074 | A1 | 1/2016 | Mian et al. | |
| 2016/0026213 | A1 | 1/2016 | Li et al. | |
| 2016/0205509 | A1 | 7/2016 | Hopcraft et al. | |
| 2017/0011606 | A1 | 1/2017 | Ceccon et al. | |
| 2017/0083857 | A1 | 3/2017 | Barton et al. | |
| 2017/0286903 | A1* | 10/2017 | Elizondo, II | G06K 7/1413 |
| 2017/0337405 | A1 | 11/2017 | Schutz | |
| 2018/0163095 | A1* | 6/2018 | Khoche | C09J 7/38 |
| 2019/0087702 | A1 | 3/2019 | Cotoc | |
| 2020/0234098 | A1 | 7/2020 | Volkerink | |
| 2021/0027122 | A1 | 1/2021 | Volkerink | |
| 2021/0150159 | A1 | 5/2021 | Volkerink | |

OTHER PUBLICATIONS

International Patent Application No. PCT/US20/26475, International Search Report and Written Opinion, dated Jul. 23, 2020, 14 pages.

Roundy et al., Energy Harvester for Rotating Environments Using Offset Pendulum and Nonlinear Dynamics, Smart Materials and Structures, IOP Publishing LTD, Sep. 9, 2014.

Ku et al., Joint Power Waveforming and Beamforming for Wireless Power Transfer, IEEE Transactions on Signal Processing, vol. 65, No. 24, Dec. 15, 2017, pp. 6409-6422.

U.S. Appl. No. 17/067,608, Ex Parte Quayle Action dated Sep. 24, 2021, 7 pages.

Ruzzeli et al., "On the RFID wake-up impulse for multi-hop sensor networks." The 1st ACM Workshop on Convergence of RFID and Wireless Sensor Networks and their Applications (SenselD) at the 5th ACM International Conference on Embedded Networked Sensor Systems (ACM SenSys 2007), Syndey, Australia, Nov. 4-9, 2007.

Ding, et al., "RFID-based Production Data Analysis in an loT-enabled Smart Job-shop." IEEE/CAA Journal of Automatics Sinica, vol. 5, No. 1, 1, Jan. 2018.

U.S. Appl. No. 16/839,048, Ex Parte Quayle Action dated Jul. 22, 2021, 6 pages.

U.S. Appl. No. 16/839,048, Notice of Allowance dated Oct. 8, 2021, 14 pages.

U.S. Appl. No. 17/027,096, Non-Final Office Action dated Jun. 24, 2021, 21 pages.

Zhai et al., A Practical Wireless Charging System Based on Ultra-Wideband Retro-Reflective Beamforming, 2010, IEEE Antennas and Propagation Society International Symposium, pp. 1-4.

* cited by examiner

601

602

1200

1500

NEXT GENERATION BUILDING ACCESS CONTROL, INDOOR LOCATIONING, AND INTERACTION TRACKING

The present disclosure claims priority to U.S. Provisional Patent Application No. 63/026,722, filed May 18, 2020, U.S. Provisional Patent Application No. 63/026,067, filed May 17, 2020, and U.S. Provisional Patent Application No. 63/087,304, filed Oct. 5, 2020, each of which are incorporated herein in their entirety.

FIELD OF THE DISCLOSURE

The disclosure generally relates to asset management and more particularly to tracking assets within environments.

BACKGROUND

In many environments, it is necessary or valuable to control flow of traffic in and within the premises. For example, in environments such as in oil refineries where employees or guests may have different permissions to access different areas of the environment, it is necessary to use access badges or cards to enter or exit different areas. However, conventional systems using RFID readers to scan access badges is often slow, requiring employees to individually interact with a RFID reader in order to gain access to the areas.

In another example, in environments such as hospitals where spread of disease may occur unnoticed due to interactions between employees and patients, it is valuable to track interactions so as to contain outbreaks as soon as possible and to alert employees and patients if they have been exposed to potential contamination.

SUMMARY

A wireless tracking system comprises a plurality of wireless tape nodes configured to identify, store, and analyze interactions occurring in an environment. Interactions may occur between users, between users and machinery or other assets within the environment, and between users and ingress and egress points in the environment. Each of these may be valuable to track for a variety of applications. Interactions may be associated with conditions, such as having a time duration more or less than a specified threshold or requiring entities to be within a threshold proximity of each other, and/or with permissions, such as user access permissions to areas of an environment.

Wireless tape nodes are configured to transmit and/or receive data when in use in the environment. In some embodiments, wireless tape nodes may transmit and/or receive data based on sleep and active modes in order to reduce battery use. Responsive to receiving data corresponding to a potential interaction, the wireless tape nodes determine whether the interaction meets one or more relevant conditions or permissions and stores information describing the interaction in a local memory. Information describing the interaction may comprise, for example, an identifier of another tape node participating in the interaction, a timestamp of the interaction, location data of the interaction, and sensor data corresponding to a time and location of the interaction.

At a later time, wireless tape nodes communicate with other entities of wireless tracking systems to upload stored interaction information. The entities may be, for example, gateway nodes, clouds, or servers of the wireless tracking system.

When events are detected, entities of the wireless tracking system retrieve stored interaction data to track a history of interactions associated with the event. For example, an event may a contamination event wherein contagious diseases may be spread between users in an environment. In another example, an event may comprise a machinery failure event wherein a piece of machinery in the environment experiences damage or failure. In each example, it is valuable to determine a history of interactions corresponding to the event, such that users that may have caused or been affected by the event may be located and notified.

Embodiments of the subject matter described in this specification include methods, processes, systems, apparatus, and tangible non-transitory carrier media encoded with one or more program instructions for carrying out one or more methods and processes for enabling the various functionalities of the described systems and apparatus.

Other features, aspects, objects, and advantages of the subject matter described in this specification will become apparent from the description, the drawings, and the claims.

BRIEF DESCRIPTION OF DRAWINGS

FIG. 12 is a flow diagram of a method of capturing interactions by wireless tape nodes of a wireless tracking system, in accordance with some embodiments

DETAILED DESCRIPTION

Introduction

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

As used herein, the term "or" refers an inclusive "or" rather than an exclusive "or." In addition, the articles "a" and "an" as used in the specification and claims mean "one or more" unless specified otherwise or clear from the context to refer the singular form.

The terms "wireless node" or "tape node" may be used interchangeably in certain contexts, and refer to an adhesive tape platform or a segment thereof that is equipped with sensor, processor, memory, energy source/harvesting mechanism, and wireless communications functionality, where the adhesive product has a variety of different form factors, including a multilayer roll or a sheet that includes a plurality of divisible adhesive segments. Once deployed, each tape node or wireless node can function, for example, as an adhesive tape, label, sticker, decal, or the like, and as a wireless communications device. A "peripheral" tape node or wireless node, also referred to as an outer node, leaf node, or terminal node, refers to a node that does not have any child nodes.

In certain contexts, the terms "wireless tracking system," "hierarchical communications network," "distributed agent operating system," and the like are used interchangeably herein to refer to a system or network of wireless nodes.

Adhesive Tape Platform

Figure 1A:
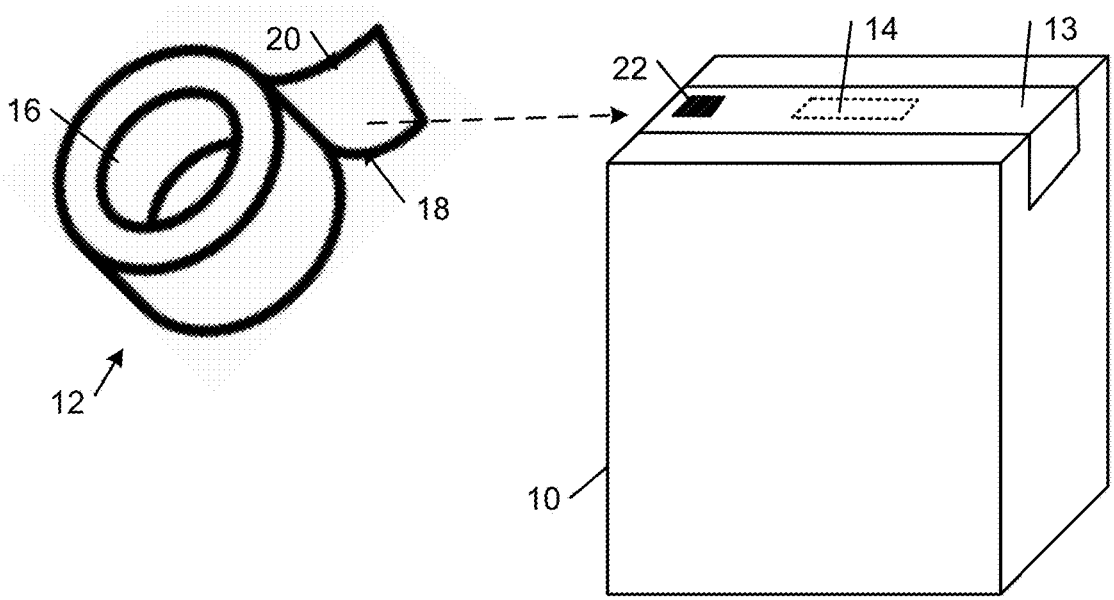
FIG. 1A is a diagrammatic view of an asset that has been sealed for shipment using a segment of an example adhesive tape platform dispensed from a roll, according to some embodiments.

FIG. 1A shows an example asset 10 that is sealed for shipment using an example adhesive tape platform 12 that includes embedded components of a wireless transducing circuit 14 (collectively referred to herein as a "tape node"). In this example, a length 13 of the adhesive tape platform 12 is dispensed from a roll 16 and affixed to the asset 10. The adhesive tape platform 12 includes an adhesive side 18 and a non-adhesive side 20. The adhesive tape platform 12 can be dispensed from the roll 16 in the same way as any conventional packing tape, shipping tape, or duct tape. For example, the adhesive tape platform 12 may be dispensed from the roll 16 by hand, laid across the seam where the two top flaps of the asset 10 meet, and cut to a suitable length either by hand or using a cutting instrument (e.g., scissors or an automated or manual tape dispenser). Examples of such tapes include tapes having non-adhesive sides 20 that carry one or more coatings or layers (e.g., colored, light reflective, light absorbing, and/or light emitting coatings or layers).

Figure 1B:
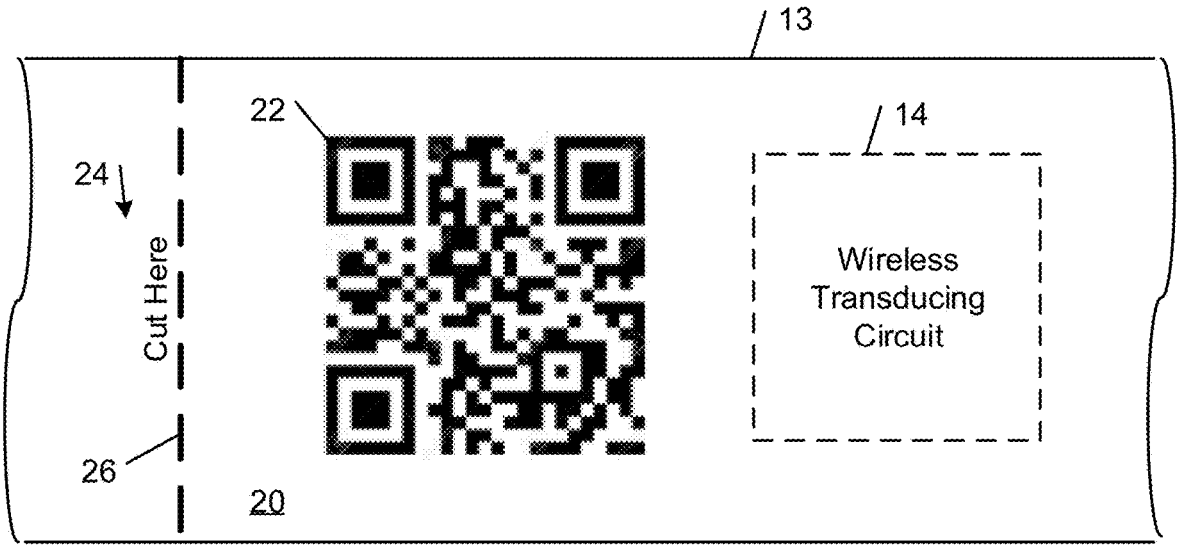
FIG. 1B is a diagrammatic top view of a portion of the segment of the example adhesive tape platform shown in FIG. 1A, according to some embodiments.

Referring to FIG. 1B, in some examples, the non-adhesive side 20 of the length 13 of the adhesive tape platform 12 includes writing or other markings that convey instructions, warnings, or other information to a person or machine (e.g., a bar code reader), or may simply be decorative and/or entertaining. For example, different types of adhesive tape platforms may be marked with distinctive colorations to distinguish one type of adhesive tape platform from another. In the illustrated example, the length 13 of the adhesive tape platform 12 includes a two-dimensional bar code (e.g., a QR Code) 22, written instructions 24 (i.e., "Cut Here"), and an associated cut line 26 that indicates where the user should cut the adhesive tape platform 12. The written instructions 24 and the cut line 26 typically are printed or otherwise marked on the top non-adhesive surface 20 of the adhesive tape platform 12 during manufacture. The two-dimensional bar code 22, on the other hand, may be marked on the non-adhesive surface 20 of the adhesive tape platform 12 during the manufacture of the adhesive product 12 or, alternatively, may be marked on the non-adhesive surface 20 of the adhesive tape platform 12 as needed using, for example, a printer or other marking device.

In order to avoid damage to the functionality of the segments of the adhesive tape platform 12, the cut lines 26 typically demarcate the boundaries between adjacent segments at locations that are free of any active components of the wireless transducing circuit 14. The spacing between the wireless transducing circuit components 14 and the cut lines 26 may vary depending on the intended communication, transducing and/or adhesive taping application. In the example illustrated in FIG. 1A, the length of the adhesive tape platform 12 that is dispensed to seal the asset 10 corresponds to a single segment of the adhesive tape platform 12. In other examples, the length of the adhesive tape platform 12 needed to seal a asset or otherwise serve the adhesive function for which the adhesive tape platform 12 is being applied may include multiple segments 13 of the adhesive tape platform 12, one or more of which segments 13 may be activated upon cutting the length of the adhesive tape platform 12 from the roll 16 and/or applying the length of the adhesive tape platform to the asset 10.

In some examples, the transducing components 14 that are embedded in one or more segments 13 of the adhesive tape platform 12 are activated when the adhesive tape platform 12 is cut along the cut line 26. In these examples, the adhesive tape platform 12 includes one or more embedded energy sources (e.g., thin film batteries, which may be printed, or conventional cell batteries, such as conventional watch style batteries, rechargeable batteries, or other energy storage device, such as a super capacitor or charge pump) that supply power to the transducing components 14 in one or more segments of the adhesive tape platform 12 in response to being separated from the adhesive tape platform 12 (e.g., along the cut line 26).

In some examples, each segment 13 of the adhesive tape platform 12 includes its own respective energy source including energy harvesting elements that can harvest energy from the environment. In some of these examples, each energy source is configured to only supply power to the components in its respective adhesive tape platform segment regardless of the number of contiguous segments 13 that are in a given length of the adhesive tape platform 12. In other examples, when a given length of the adhesive tape platform 12 includes multiple segments 13, the energy sources in the respective segments 13 are configured to supply power to the transducing components 14 in all of the segments 13 in the given length of the adhesive tape platform 12. In some of these examples, the energy sources are connected in parallel and concurrently activated to power the transducing components 14 in all of the segments 13 at the same time. In other examples, the energy sources are connected in parallel and alternately activated to power the transducing components 14 in respective ones of the adhesive tape platform segments 13 at different time periods, which may or may not overlap.

Figure 2:
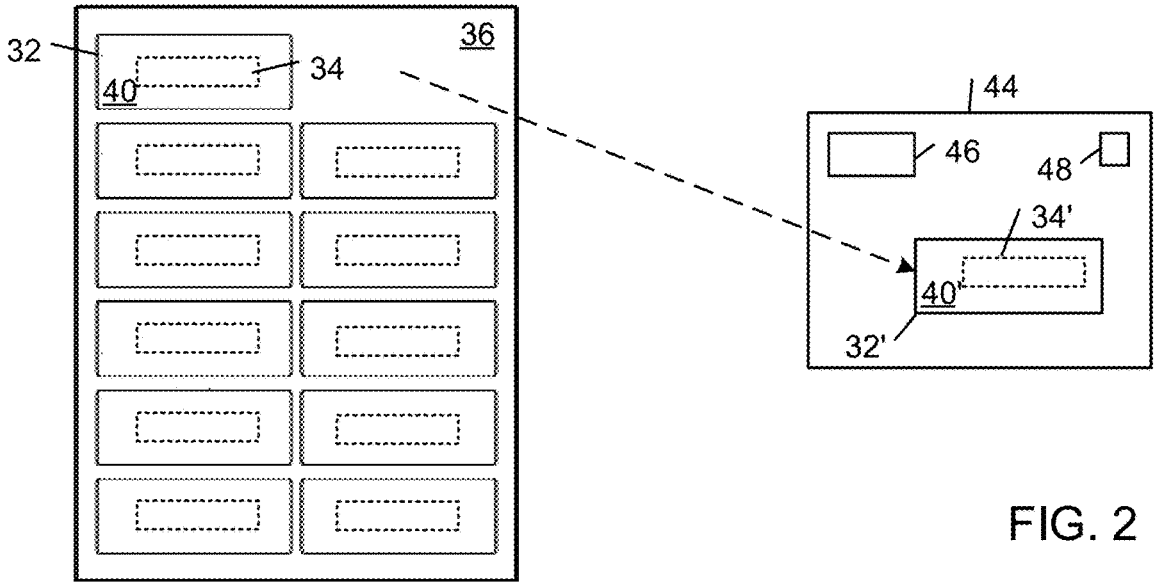
FIG. 2 is a diagrammatic view of an example of an envelope carrying a segment of an example adhesive tape platform dispensed from a backing sheet, according to some embodiments.

FIG. 2 shows an example adhesive tape platform 30 that includes a set of adhesive tape platform segments 32 each of which includes a respective set of embedded wireless transducing circuit components 34, and a backing sheet 36 with a release coating that prevents the adhesive segments 32 from adhering strongly to the backing sheet 36. Each adhesive tape platform segment 32 includes an adhesive side facing the backing sheet 36, and an opposing non-adhesive side 40. In this example, a particular segment 32' of the adhesive tape platform 30 has been removed from the backing sheet 36 and affixed to an envelope 44. Each segment 32 of the adhesive tape platform 30 can be removed from the backing sheet 36 in the same way that adhesive labels can be removed from a conventional sheet of adhesive labels (e.g., by manually peeling a segment 32 from the backing sheet 36). In general, the non-adhesive side 40' of the segment 32' may include any type of writing, markings, decorative designs, or other ornamentation. In the illustrated example, the non-adhesive side 40' of the segment 32' includes writing or other markings that correspond to a destination address for the envelope 44. The envelope 44 also includes a return address 46 and, optionally, a postage stamp or mark 48.

In some examples, segments of the adhesive tape platform 12 are deployed by a human operator. The human operator may be equipped with a mobile phone or other device that allows the operator to authenticate and initialize the adhesive tape platform 12. In addition, the operator can take a picture of an asset including the adhesive tape platform and any barcodes associated with the asset and, thereby, create a persistent record that links the adhesive tape platform 12 to the asset. In addition, the human operator typically will send the picture to a network service and/or transmit the picture to the adhesive tape platform 12 for storage in a memory component of the adhesive tape platform 12.

In some examples, the wireless transducing circuit components 34 that are embedded in a segment 32 of the adhesive tape platform 12 are activated when the segment 32 is removed from the backing sheet 32. In some of these examples, each segment 32 includes an embedded capacitive sensing system that can sense a change in capacitance when the segment 32 is removed from the backing sheet 36. As explained in detail below, a segment 32 of the adhesive tape platform 30 includes one or more embedded energy sources (e.g., thin film batteries, common disk-shaped cell batteries, or rechargeable batteries or other energy storage devices, such as a super capacitor or charge pump) that can be configured to supply power to the wireless transducing circuit components 34 in the segment 32 in response to the detection of a change in capacitance between the segment 32 and the backing sheet 36 as a result of removing the segment 32 from the backing sheet 36.

Figure 3:
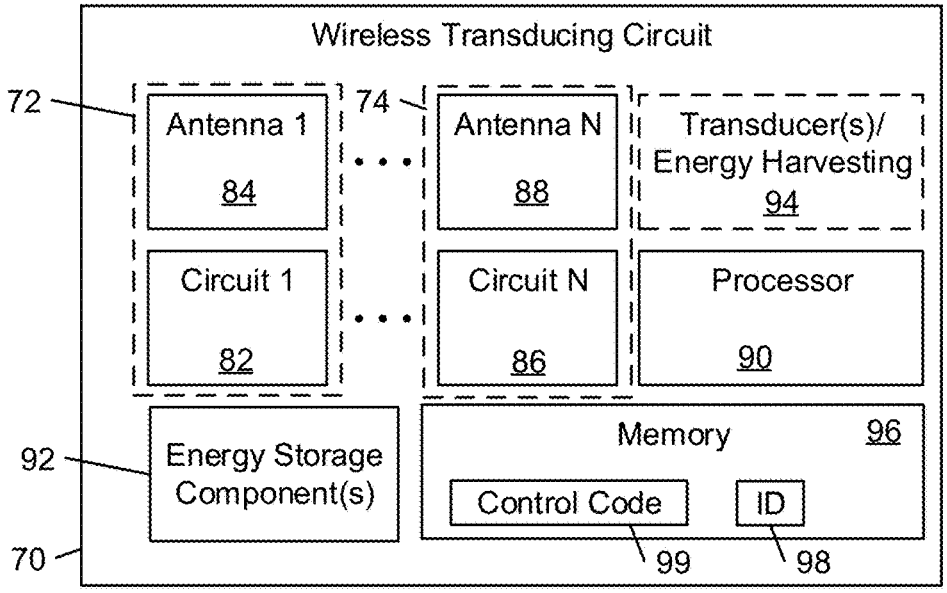
FIG. 3 is a schematic view of an example segment of an adhesive tape platform, according to some embodiments.

FIG. 3 shows a block diagram of the components of an example wireless transducing circuit 70 that includes a number of communication systems 72, 74. Example communication systems 72, 74 include a GPS system that includes a GPS receiver circuit 82 (e.g., a receiver integrated circuit) and a GPS antenna 84, and one or more wireless communication systems each of which includes a respective transceiver circuit 86 (e.g., a transceiver integrated circuit) and a respective antenna 88. Example wireless communication systems include a cellular communication system (e.g., GSM/GPRS), a Wi-Fi communication system, an RF communication system (e.g., LoRa), a Bluetooth communication system (e.g., a Bluetooth Low Energy system), a Z-wave communication system, and a ZigBee communication system. The wireless transducing circuit 70 also includes a processor 90 (e.g., a microcontroller or microprocessor), one or more energy storage devices 92 (e.g., non-rechargeable or rechargeable printed flexible battery, conventional single or multiple cell battery, and/or a super capacitor or charge pump), one or more transducers 94 (e.g., sensors and/or actuators, and, optionally, one or more energy harvesting transducer components). In some examples, the conventional single or multiple cell battery may be a watch style disk or button cell battery that is associated electrical connection apparatus (e.g., a metal clip) that electrically connects the electrodes of the battery to contact pads on the flexible circuit 116.

Examples of sensing transducers 94 include a capacitive sensor, an altimeter, a gyroscope, an accelerometer, a temperature sensor, a strain sensor, a pressure sensor, a piezoelectric sensor, a weight sensor, an optical or light sensor (e.g., a photodiode or a camera), an acoustic or sound sensor (e.g., a microphone), a smoke detector, a radioactivity sensor, a chemical sensor (e.g., an explosives detector), a biosensor (e.g., a blood glucose biosensor, odor detectors, antibody based pathogen, food, and water contaminant and toxin detectors, DNA detectors, microbial detectors, pregnancy detectors, and ozone detectors), a magnetic sensor, an electromagnetic field sensor, and a humidity sensor. Examples of actuating (e.g., energy emitting) transducers 94 include light emitting components (e.g., light emitting diodes and displays), electro-acoustic transducers (e.g., audio speakers), electric motors, and thermal radiators (e.g., an electrical resistor or a thermoelectric cooler).

In some examples, the wireless transducing circuit 70 includes a memory 96 for storing data, including, e.g., profile data, state data, event data, sensor data, localization data, security data, and one or more unique identifiers (ID) 98 associated with the wireless transducing circuit 70, such as a product ID, a type ID, and a media access control (MAC) ID, and control code 99. In some examples, the memory 96 may be incorporated into one or more of the processor 90 or transducers 94, or may be a separate component that is integrated in the wireless transducing circuit 70 as shown in FIG. 3. The control code typically is implemented as programmatic functions or program modules that control the operation of the wireless transducing circuit 70, including a tape node communication manager that manages the manner and timing of tape node communications, a tape node power manager that manages power consumption, and a tape node connection manager that controls whether connections with other tape nodes are secure connections or unsecure connections, and a tape node storage manager that securely manages the local data storage on the node. The tape node connection manager ensures the level of security required by the end application and supports various encryption mechanisms. The tape node power manager and tape communication manager work together to optimize the battery consumption for data communication. In some examples, execution of the control code by the different types of tape nodes described herein may result in the performance of similar or different functions.

Figure 4:
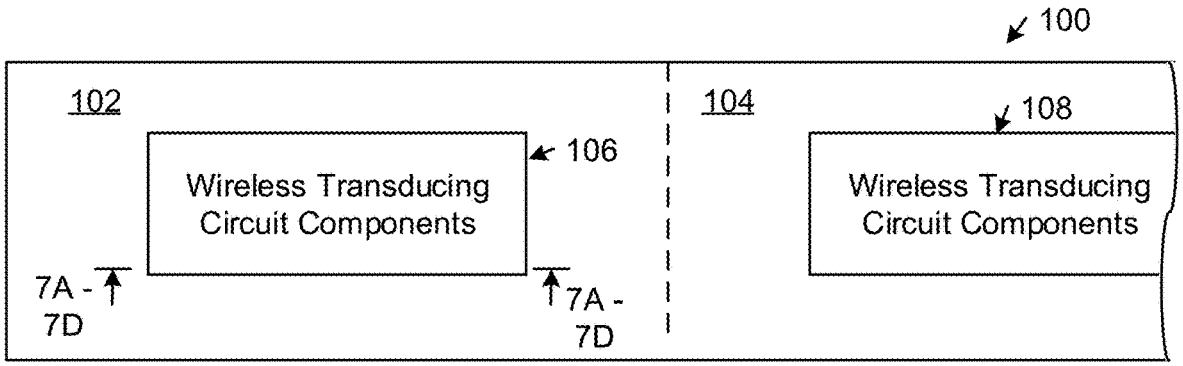
FIG. 4 is a diagrammatic top view of a length of an example adhesive tape platform, according to some embodiments.

FIG. 4 is a top view of a portion of an example flexible adhesive tape platform 100 that shows a first segment 102 and a portion of a second segment 104. Each segment 102, 104 of the flexible adhesive tape platform 100 includes a respective set 106, 108 of the components of the wireless transducing circuit 70. The segments 102, 104 and their respective sets of components 106, 108 typically are identical and configured in the same way. In some other embodiments, however, the segments 102, 104 and/or their respective sets of components 106, 108 are different and/or configured in different ways. For example, in some examples, different sets of the segments of the flexible adhesive tape platform 100 have different sets or configurations of tracking and/or transducing components that are designed and/or optimized for different applications, or different sets of segments of the flexible adhesive tape platform may have different ornamentations (e.g., markings on the exterior surface of the platform) and/or different (e.g., alternating) lengths.

An example method of fabricating the adhesive tape platform 100 (see FIG. 4) according to a roll-to-roll fabrication process is described in connection with FIGS. 6, 7A, and 7B of U.S. patent application Ser. No. 15/842,861, filed Dec. 14, 2017, the entirety of which is incorporated herein by reference.

The instant specification describes an example system of adhesive tape platforms (also referred to herein as "tape nodes") that can be used to implement a low-cost wireless network infrastructure for performing monitoring, tracking, and other asset management functions relating to, for example, parcels, persons, tools, equipment and other physical assets and objects. The example system includes a set of three different types of tape nodes that have different respective functionalities and different respective cover markings that visually distinguish the different tape node types from one another. In one non-limiting example, the covers of the different tape node types are marked with different colors (e.g., white, green, and black). In the illustrated examples, the different tape node types are distinguishable from one another by their respective wireless communications capabilities and their respective sensing capabilities.

Figure 5A:
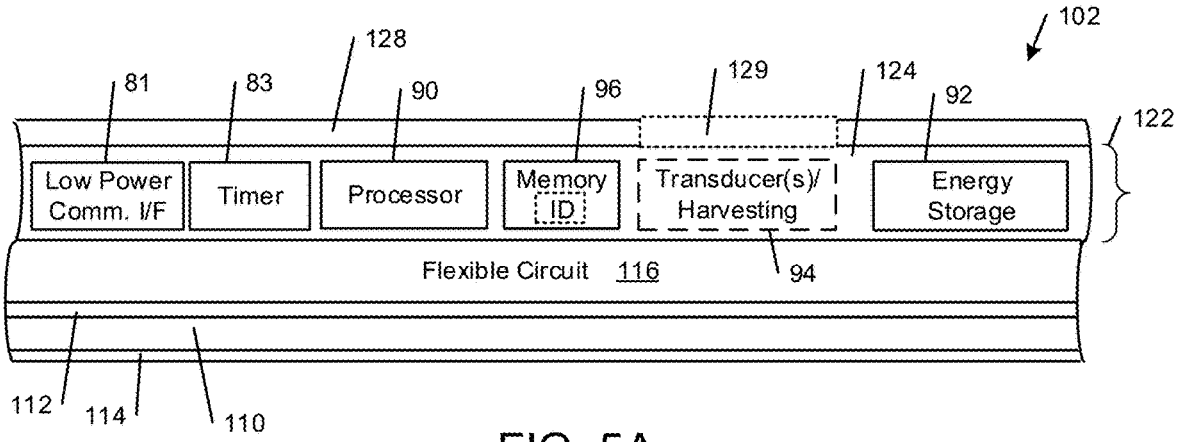
FIGS. 5A-5C show diagrammatic cross-sectional side views of portions of different respective adhesive tape platforms, according to some embodiments.

FIG. 5A shows a cross-sectional side view of a portion of an example segment 102 of the flexible adhesive tape platform 100 that includes a respective set of the components of the wireless transducing circuit 106 corresponding to the first tape node type (i.e., white). The flexible adhesive tape platform segment 102 includes an adhesive layer 112, an optional flexible substrate 110, and an optional adhesive layer 114 on the bottom surface of the flexible substrate 110. If the bottom adhesive layer 114 is present, a release liner (not shown) may be (weakly) adhered to the bottom surface of the adhesive layer 114. In some examples, the adhesive layer 114 includes an adhesive (e.g., an acrylic foam adhesive) that has a high bond strength that is sufficient to prevent removal of the adhesive segment 102 from a surface on which the adhesive layer 114 is adhered without destroying the physical or mechanical integrity of the adhesive segment 102 and/or one or more of its constituent components. In some examples, the optional flexible substrate 110 is implemented as a prefabricated adhesive tape that includes the adhesive layers 112, 114 and the optional release liner. In other examples, the adhesive layers 112, 114 are applied to the top and bottom surfaces of the flexible substrate 110 during the fabrication of the adhesive tape platform 100. The adhesive layer 112 bonds the flexible substrate 110 to a bottom surface of a flexible circuit 116, that includes one or more wiring layers (not shown) that connect the processor 90, a low power wireless communication interface 81 (e.g., a Zigbee, Bluetooth® Low Energy (BLE) interface, or other low power communication interface), a timer circuit 83, transducing and/or energy harvesting component(s) 94 (if present), the memory 96, and other components in a device layer 122 to each other and to the energy storage component 92 and, thereby, enable the transducing, tracking and other functionalities of the flexible adhesive tape platform segment 102. The low power wireless communication interface 81 typically includes one or more of the antennas 84, 88 and one or more of the wireless circuits 82, 86.

Figure 5B:
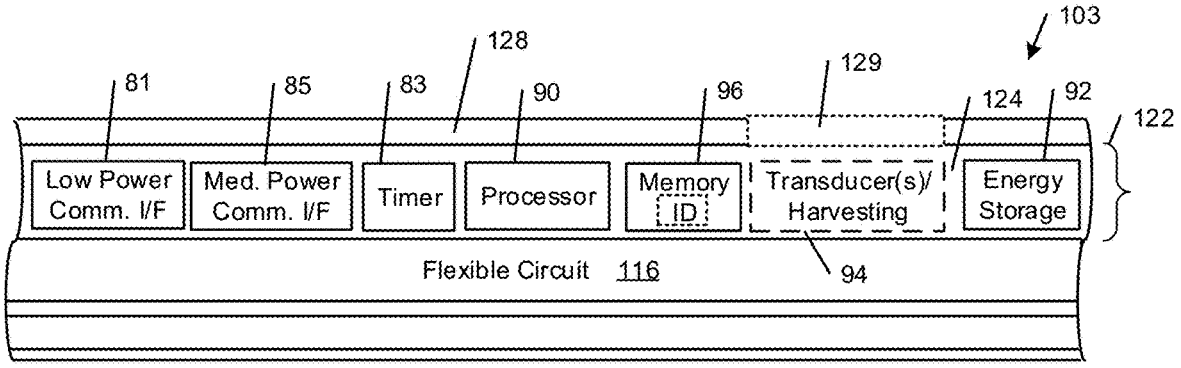

FIG. 5B shows a cross-sectional side view of a portion of an example segment 103 of the flexible adhesive tape platform 100 that includes a respective set of the components of the wireless transducing circuit 106 corresponding to the second tape node type (i.e., green). In this example, the flexible adhesive tape platform segment 103 differs from the segment 102 shown in FIG. 5A by the inclusion of a medium power communication interface 85 (e.g., a LoRa interface) in addition to the low power communications interface that is present in the first tape node type (i.e., white). The medium power communication interface has longer communication range than the low power communication interface. In some examples, one or more other components of the flexible adhesive tape platform segment 103 differ, for example, in functionality or capacity (e.g., larger energy source).

Figure 5C:
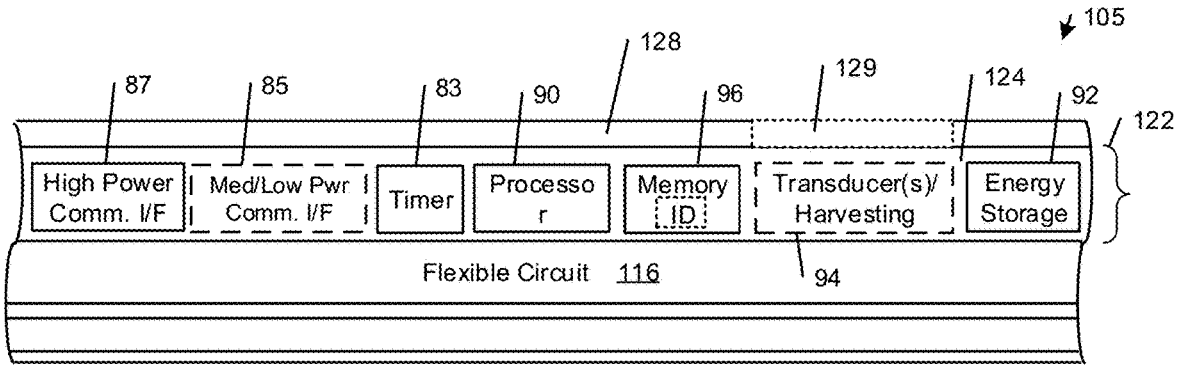

FIG. 5C shows a cross-sectional side view of a portion of an example segment 105 of the flexible adhesive tape platform 100 that includes a respective set of the components of the wireless transducing circuit 106 corresponding to the third tape node type (i.e., black). In this example, the flexible adhesive tape platform segment 105 includes a high power communications interface 87 (e.g., a cellular interface; e.g., GSM/GPRS) and an optional medium and/or low power communications interface 85. The high power communication range provides global coverage to available infrastructure (e.g. the cellular network). In some examples, one or more other components of the flexible adhesive tape platform segment 105 differ, for example, in functionality or capacity (e.g., larger energy source).

FIGS. 5A-5C show examples in which the cover layer 128 of the flexible adhesive tape platform 100 includes one or more interfacial regions 129 positioned over one or more of the transducers 94. In examples, one or more of the interfacial regions 129 have features, properties, compositions, dimensions, and/or characteristics that are designed to improve the operating performance of the platform 100 for specific applications. In some examples, the flexible adhesive tape platform 100 includes multiple interfacial regions 129 over respective transducers 94, which may be the same or different depending on the target applications. Example interfacial regions include an opening, an optically transparent window, and/or a membrane located in the interfacial region 129 of the cover 128 that is positioned over the one or more transducers and/or energy harvesting components 94. Additional details regarding the structure and operation of example interfacial regions 129 are described in U.S.

Provisional Patent Application No. 62/680,716, filed Jun. 5, 2018, and U.S. Provisional Patent Application No. 62/670,712, filed May 11, 2018.

In some examples, a flexible polymer layer 124 encapsulates the device layer 122 and thereby reduces the risk of damage that may result from the intrusion of contaminants and/or liquids (e.g., water) into the device layer 122. The flexible polymer layer 124 also planarizes the device layer 122. This facilitates optional stacking of additional layers on the device layer 122 and also distributes forces generated in, on, or across the adhesive tape platform segment 102 so as to reduce potentially damaging asymmetric stresses that might be caused by the application of bending, torqueing, pressing, or other forces that may be applied to the flexible adhesive tape platform segment 102 during use. In the illustrated example, a flexible cover 128 is bonded to the planarizing polymer 124 by an adhesive layer (not shown).

The flexible cover 128 and the flexible substrate 110 may have the same or different compositions depending on the intended application. In some examples, one or both of the flexible cover 128 and the flexible substrate 110 include flexible film layers and/or paper substrates, where the film layers may have reflective surfaces or reflective surface coatings. Example compositions for the flexible film layers include polymer films, such as polyester, polyimide, polyethylene terephthalate (PET), and other plastics. The optional adhesive layer on the bottom surface of the flexible cover 128 and the adhesive layers 112, 114 on the top and bottom surfaces of the flexible substrate 110 typically include a pressure-sensitive adhesive (e.g., a silicon-based adhesive). In some examples, the adhesive layers are applied to the flexible cover 128 and the flexible substrate 110 during manufacture of the adhesive tape platform 100 (e.g., during a roll-to-roll or sheet-to-sheet fabrication process). In other examples, the flexible cover 128 may be implemented by a prefabricated single-sided pressure-sensitive adhesive tape and the flexible substrate 110 may be implemented by a prefabricated double-sided pressure-sensitive adhesive tape; both kinds of tape may be readily incorporated into a roll-to-roll or sheet-to-sheet fabrication process. In some examples, the flexible polymer layer 124 is composed of a flexible epoxy (e.g., silicone).

In some examples, the energy storage device 92 is a flexible battery that includes a printed electrochemical cell, which includes a planar arrangement of an anode and a cathode and battery contact pads. In some examples, the flexible battery may include lithium-ion cells or nickel-cadmium electro-chemical cells. The flexible battery typically is formed by a process that includes printing or laminating the electro-chemical cells on a flexible substrate (e.g., a polymer film layer). In some examples, other components may be integrated on the same substrate as the flexible battery. For example, the low power wireless communication interface 81 and/or the processor(s) 90 may be integrated on the flexible battery substrate. In some examples, one or more of such components also (e.g., the flexible antennas and the flexible interconnect circuits) may be printed on the flexible battery substrate.

In some examples, the flexible circuit 116 is formed on a flexible substrate by printing, etching, or laminating circuit patterns on the flexible substrate. In some examples, the flexible circuit 116 is implemented by one or more of a single-sided flex circuit, a double access or back bared flex circuit, a sculpted flex circuit, a double-sided flex circuit, a multi-layer flex circuit, a rigid flex circuit, and a polymer thick film flex circuit. A single-sided flexible circuit has a single conductor layer made of, for example, a metal or conductive (e.g., metal filled) polymer on a flexible dielectric film. A double access or back bared flexible circuit has a single conductor layer but is processed so as to allow access to selected features of the conductor pattern from both sides. A sculpted flex circuit is formed using a multi-step etching process that produces a flex circuit that has finished copper conductors that vary in thickness along their respective lengths. A multilayer flex circuit has three of more layers of conductors, where the layers typically are interconnected using plated through holes. Rigid flex circuits are a hybrid construction of flex circuit consisting of rigid and flexible substrates that are laminated together into a single structure, where the layers typically are electrically interconnected via plated through holes. In polymer thick film (PTF) flex circuits, the circuit conductors are printed onto a polymer base film, where there may be a single conductor layer or multiple conductor layers that are insulated from one another by respective printed insulating layers.

In the example flexible adhesive tape platform segments 102 shown in FIGS. 5A-5C, the flexible circuit 116 is a single access flex circuit that interconnects the components of the adhesive tape platform on a single side of the flexible circuit 116. In other examples, the flexible circuit 116 is a double access flex circuit that includes a front-side conductive pattern that interconnects the low power communications interface 81, the timer circuit 83, the processor 90, the one or more transducers 94 (if present), and the memory 96, and allows through-hole access (not shown) to a back-side conductive pattern that is connected to the flexible battery (not shown). In these examples, the front-side conductive pattern of the flexible circuit 116 connects the communications circuits 82, 86 (e.g., receivers, transmitters, and transceivers) to their respective antennas 84, 88 and to the processor 90, and also connects the processor 90 to the one or more sensors 94 and the memory 96. The backside conductive pattern connects the active electronics (e.g., the processor 90, the communications circuits 82, 86, and the transducers) on the front-side of the flexible circuit 116 to the electrodes of the flexible battery 116 via one or more through holes in the substrate of the flexible circuit 116.

Depending on the target application, the wireless transducing circuits 70 are distributed across the flexible adhesive tape platform 100 according to a specified sampling density, which is the number of wireless transducing circuits 70 for a given unit size (e.g., length or area) of the flexible adhesive tape platform 100. In some examples, a set of multiple flexible adhesive tape platforms 100 are provided that include different respective sampling densities in order to seal different asset sizes with a desired number of wireless transducing circuits 70. In particular, the number of wireless transducing circuits per asset size is given by the product of the sampling density specified for the adhesive tape platform and the respective size of the adhesive tape platform 100 needed to seal the asset. This allows an automated packaging system to select the appropriate type of flexible adhesive tape platform 100 to use for sealing a given asset with the desired redundancy (if any) in the number of wireless transducer circuits 70. In some example applications (e.g., shipping low value goods), only one wireless transducing circuit 70 is used per asset, whereas in other applications (e.g., shipping high value goods) multiple wireless transducing circuits 70 are used per asset. Thus, a flexible adhesive tape platform 100 with a lower sampling density of wireless transducing circuits 70 can be used for the former application, and a flexible adhesive tape platform 100 with a higher sampling density of wireless transducing circuits 70 can be used for the latter application. In some examples, the flexible adhesive tape platforms 100 are color-coded or otherwise marked to indicate the respective sampling densities with which the wireless transducing circuits 70 are distributed across the different types of adhesive tape platforms 100.

Environment of Wireless Tracking System

Figure 6A:
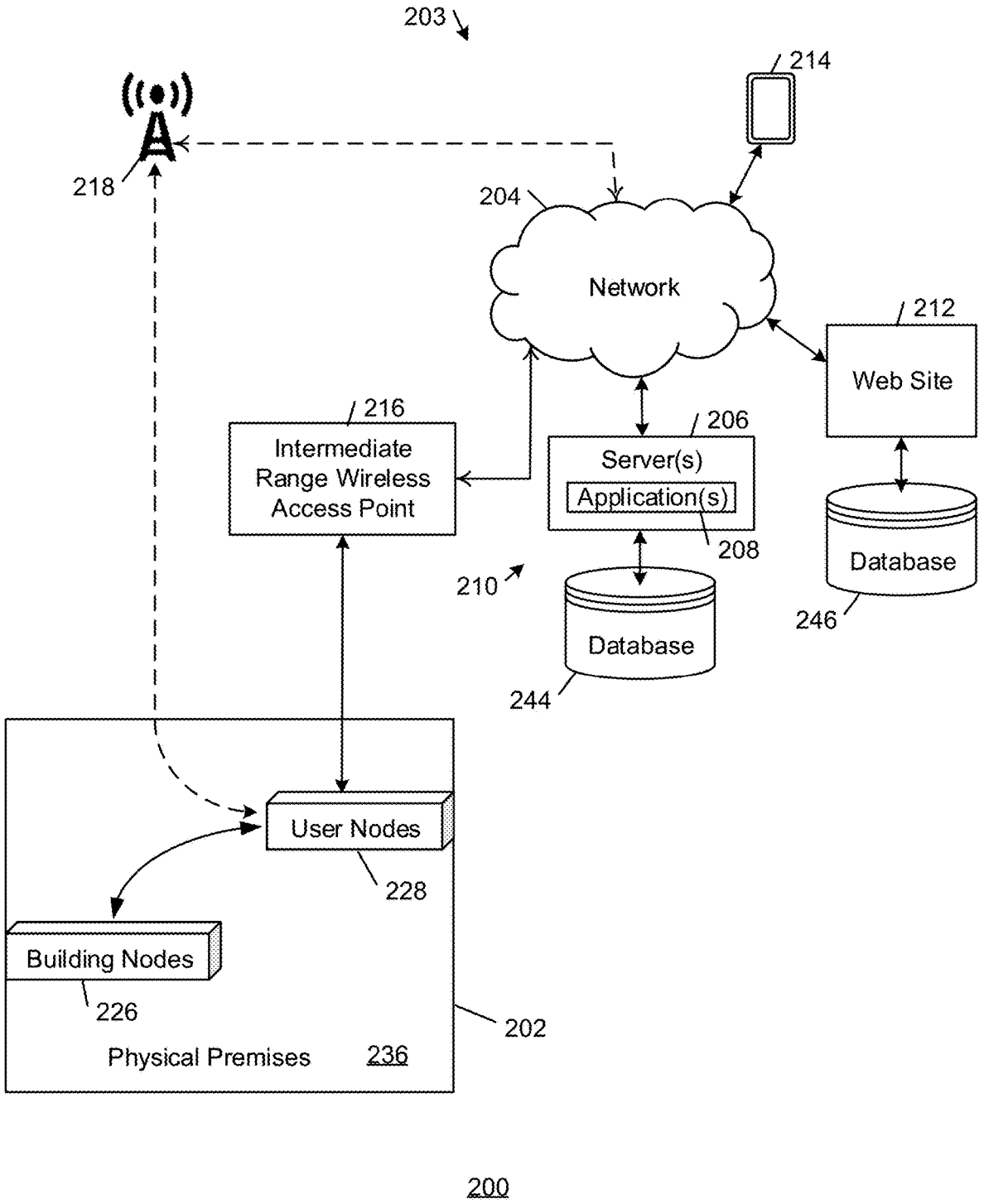
FIGS. 6A-6C are diagrams showing example environments of a wireless tracking system, according to some embodiments, according to some embodiments.
Figure 6B:
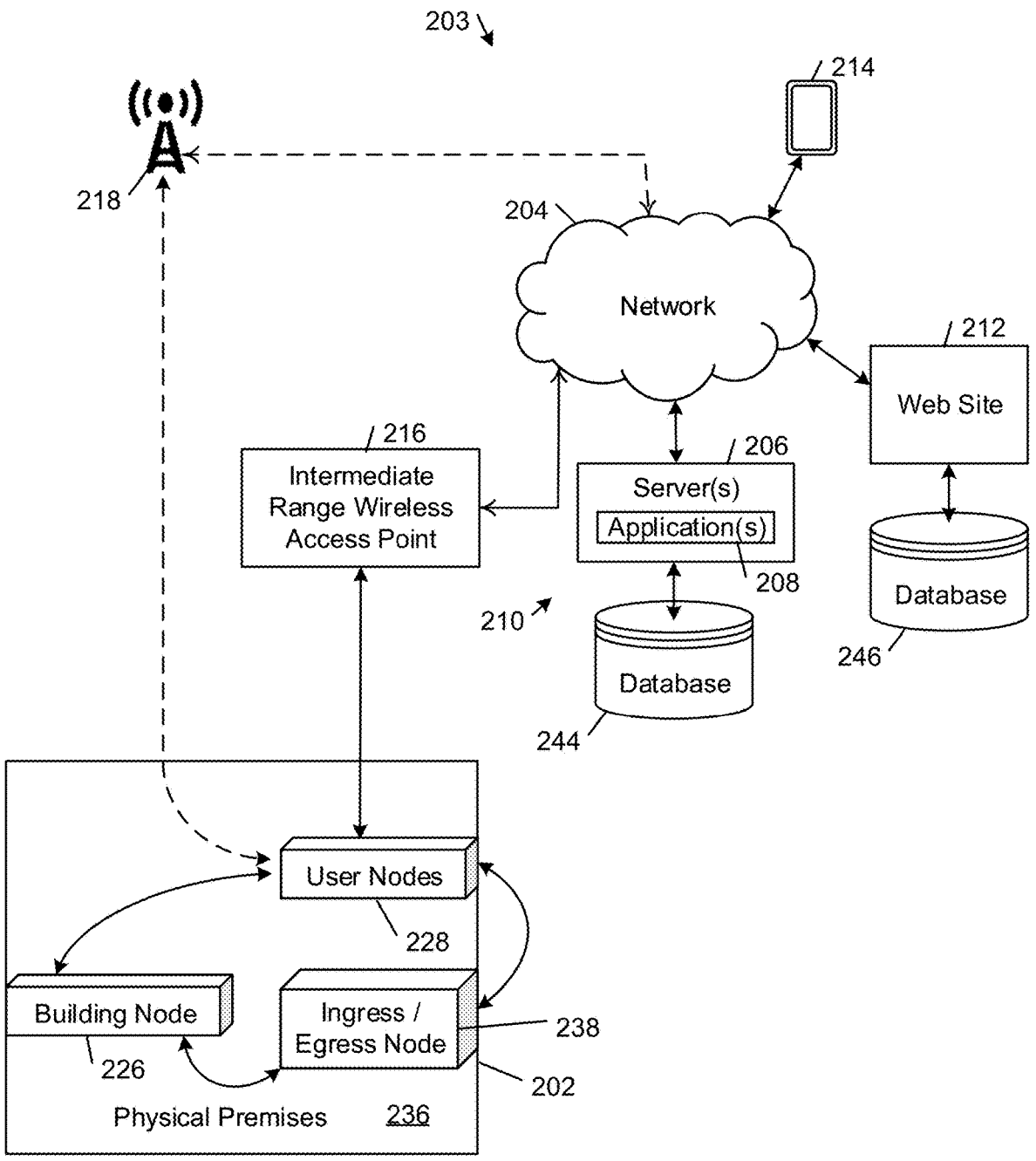
Figure 6C:
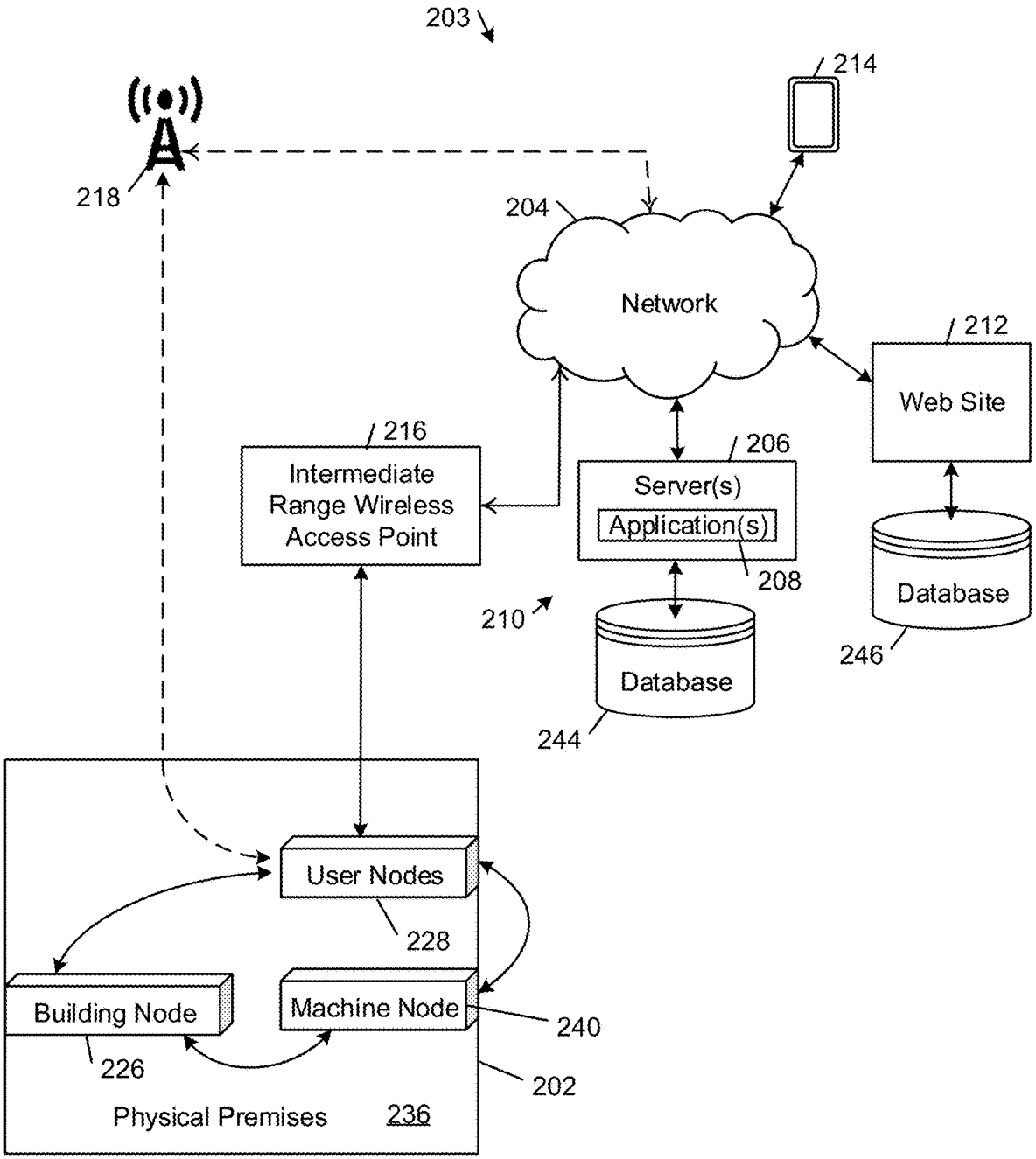

FIGS. 6A-6C are diagrams showing example environments of a wireless tracking system, according to some embodiments.

FIG. 6A shows an example of a network communications environment 200 that includes an architectural platform 202 on which a wide variety of different wireless IOT applications can be implemented, including, for example, industrial internet-of-things applications. In the illustrated embodiments, the architectural platform 202 is a platform implemented in physical premises 236 that may include a plurality of wireless nodes. The physical premises 236 are an area where the IOT application is being used, according to some embodiments. For example, the physical premises 236 is a building including a number of tape nodes for tracking the location and environmental condition of assets inside the building. In other examples, the physical premises 236 may include an outdoor area, a warehouse facility, a manufacturing facility, a shipping and receiving center, a distribution center, a transportation hub, or some other physical location. The architectural platform 202 may be connected to a distributed network service infrastructure 203. Part of the distributed network service infrastructure 203 may be housed in the physical premises 236, according to some embodiments. For example, the intermediate range wireless access point 216 may be physically located on the physical premises 236 or within a threshold distance from the physical premises 236.

The distributed network service infrastructure 203 includes a network 204 (e.g., the internet) that supports communications with one or more servers 206 executing one or more applications 208 of a network service 210, a web site/app 212 associated with the network service 210, a computing device 214 (e.g., a mobile phone, a smart phone, a tablet, laptop computer, or the like), and optionally one or more access points including an intermediate range wireless access point 216 (e.g., a LoRaWAN) and a cellular access point 218. In some examples, the distributed network service infrastructure includes one or more network communication systems and technologies, including any one or more of wide area networks, local area networks, public networks (e.g., the internet), private networks (e.g., intranets and extranets), wired networks, and wireless networks. The distributed network service infrastructure also may include communications infrastructure equipment, such as a geolocation satellite system (e.g., GPS, GLONASS, and NAVSTAR), cellular communication systems 218 (e.g., GSM/GPRS), Wi-Fi communication systems, and RF communication systems 216 (e.g., LoRaWAN).

In the illustrated example, the network service 210 includes a user application 208 that executes on a client device 214 to enable an administrator of the network service 210 to configure and retrieve status and sensor data from components (e.g., wireless network devices, also referred to as "network nodes") of the transient network infrastructure in the physical premises 236. The disclosed embodiments utilize different types of network nodes to collect data from the physical premises 236, including master network nodes, intermediate, and peripheral network nodes. Examples of the types of data that may be collected by the network nodes include asset status information, event data, and sensor data (e.g., temperature data, acceleration data, location data, etc.).

The network service 210 stores in an end-user database 244 user account information and data obtained from a master node and the peripheral nodes. In the illustrated example, users of the network service 210 may utilize a web browser application to access the web site/app 212, which provides access to a database 246 that stores end-user data for each user of the web site/app 212. In the example shown in FIG. 9, users can access the web site/app 212 to obtain information regarding, for example, the shipping status, location, and/or condition of relevant assets or parcels, as well as other information concerning the users' assets, parcels, and other items.

In general, the network infrastructure can be implemented by a wide variety of wireless network nodes. In some embodiments, the network infrastructure includes various types of tape nodes in the physical premises 236, including a master tape node, one or more intermediate tape nodes, and peripheral tape nodes. In some examples, multiple classes or types of tape nodes are used to implement a particular application, where each tape node class has a different respective set of roles, functionalities and/or capabilities. In some examples, the master node and peripheral tape nodes communicate in the physical premises over local channels implemented using low-power wireless communications interfaces, such as a Bluetooth communication interface (e.g., a Bluetooth Low Energy system), a Z-wave communication interface, and a ZigBee communication interface.

Communication across the network communications environment 200 is secured by a variety of different security mechanisms. In the case of existing infrastructure, a communication link uses existing infrastructure security mechanisms. In the case of communications among tapes nodes, communication is secured through a custom security mechanism. In certain cases, tape nodes can also be configured to support block chain based security measures that protect the transmitted and stored data.

The physical premises 236 may be, for example, any location in which there are persons, places or things to be monitored, tracked, sensed, or inventoried, including any building or structure, such as a warehouse, a distribution center, a manufacturing establishment, a supplier establishment, a customer establishment, a retail establishment, a restaurant, an apartment building, a hotel, a house, or other dwelling or defined space.

In the illustrated embodiment, the physical premises 236 includes one or more building nodes 226 and one or more user nodes 228. In some embodiments, a building node 226 transmits a building ID into the physical premises 236, the building ID an identifier associated with a location in the physical premises 236. The user nodes 228 and other suitably configured nodes are configured to communicate with building nodes 226 in the physical premises 236. After receiving the building ID from a building node 226, the user nodes 228 may store the building ID in memory of the user node 228, according to some embodiments.

A building node 226 is a wireless communication node that is associated with a location in the physical premises 236. A building node 226 is stationary, and its location is known and stored in the database 244, according to some embodiments. A building node 226 may also store its own location in its memory and communicate its location to other wireless nodes in the physical premises 236. Thus, a location of a non-stationary node (e.g., a user node 228) wirelessly communicating with the building node 226 can be determined to be within a threshold distance from the location of the building node based on a communication range of the wireless communication. Using received signal strength for a wireless communication signal (e.g., a Bluetooth communication signal) between the node and the building node 226 can further be used to determine a location of the node, based on the location and wireless communication signals of the building node 226. In some embodiments, the building node is a gateway device that includes two or more wireless communication systems for relaying data across a larger distance than the user nodes 228 are capable of. Thus, the user node 228 may transmit data to the building node 226 for relay to another node of the wireless tracking system. For example, the building node may communicate data with the user nodes 228 using Bluetooth communications and relay the received data over a greater distance using cellular communications. In further embodiments, the building node 226 is an embodiment of an intermediate range wireless access point 216. In some embodiments, the building node is an embodiment of a tape node. In other embodiments, the building node is a stationary node. In this case, the building node may be integrated with the infrastructure of the physical premises 236. For example, the building node 226 may receive electrical power from an electrical power line of the physical premises 236.

A gateway device (also referred to herein as a gateway node, or gateway device node), as discussed herein, may refer to a wireless node of the wireless tracking system that includes two or more wireless communication systems. A first wireless communication system of the two or more wireless communication systems has a first wireless communication range. A second wireless communication system of the two or more wireless communication systems includes a second wireless communication range. The gateway device is configured to communicate with low-range wireless nodes within the first wireless communication range using the first wireless communication system. Then, the gateway device is configured to relay, sometimes on behalf of the low-range wireless nodes, the communicated data over a longer distance using the second wireless communication system to another wireless node of the wireless tracking system, client device, or server. The gateway device may also include a processor, memory, and other components, similar to those shown in FIG. 3. In some embodiments, a gateway device may be an embodiment of a wireless tape node that includes multiple wireless communication systems. In other embodiments, the gateway device is a stationary wireless device. In further embodiments, the gateway device may be integrated with an infrastructure of a building or location, such as receiving electrical power from an electrical power line of a building or location. In other embodiments, a gateway device may be a mobile gateway that is associated with or integrated with a vehicle.

A user node 228 is a wireless communication node that is associated with a user or human operator. The user node 228 is typically a wireless tracking device that is carried on the persons of the user, according to some embodiments. In further embodiments, the user node 228 is a wearable device such as a smart watch, a smart bracelet, or a smart necklace, for example. In some cases, the user node 228 is an embodiment of a tape node that is wrapped around a body part (e.g., a wrist) of a user and worn like a bracelet, watch, or other accessory. In some embodiments, the user node 228 is a smart badge that the user carries for authentication in a building security system. The smart badge may have the form factor of an identification card. The user node 228 includes at least one or more wireless communication systems that are compatible for wireless communication with at least the building node 226. The user node 228 may include an integrated RFID or NFC communication integrated. The integrated RFID or NFC system may be a passive communication system (e.g., an inductive circuit), according to some embodiments.

Each user node 228 is associated with a user and stores an identifier for the user on its memory. For example, the user identifier may be an employee ID for the user. When the user node 228 interacts with other nodes of the wireless tracking system (e.g., the building node 226), the user node 228 may transmit the user identifier to the other nodes, according to some embodiments. The wireless tracking system associates an identifier of the user node 228 (e.g., a hardware identifier, such as a MAC address) with the user identifier and stores them as well as their association in the database 244. Thus, the wireless tracking system can infer that tracked interactions of the user node 228 correspond to real-life movement and physical interactions of the user.

Each component of the example environments 200, are included as part of a wireless tracking system that tracks interactions between nodes of the tracking system, according to some embodiments. FIGS. 6B and 6C show alternative embodiments of the wireless tracking system. In some embodiments, the tracked interactions may be used for contact tracing between user nodes 228, equipment nodes 240, and building nodes 226 of the wireless tracking system. In some embodiments, the tracked interactions may be used to authenticate or authorize user for access to restricted areas of the physical premises 236 or for operating equipment or machinery that has restricted access. Interactions between the building node 226 and the user node 228 include wireless communications between the user node 228 and the building node 226, and the interactions are tracked by the wireless tracking system. In some embodiments, the interactions include either the building node or the user node 228 determining a location of the user node 228. In further embodiments, tracked interactions in the wireless tracking system are used to track the location of the user nodes 228 through time. For example, based on a tracked interaction between a user node 228 and the building node 226 that occurred at 3:00 PM on Mar. 23, 2020, the wireless tracking system determines that the user node 228 was located in the physical premises 236 and within a threshold distance (e.g., within a Bluetooth communication range) from the location of the building node 226 at 3:00 PM on Mar. 23, 2020.

The wireless tracking system may issue alerts for events detected based on tracked interactions between nodes of the wireless tracking system. The alerts may be transmitted to one or more client devices (e.g., computers, laptops, smart phones, etc.) and to one or more wireless nodes of the wireless tracking system. An alert may be displayed to a user on a client device to warn them of the event and provide instructions on how to resolve the event. For example, a security guard may receive an alert notifying the security guard to prevent the entry of an individual which the wireless tracking system has determined has been exposed to a contagious disease, based at least in part on the tracked interactions, into a building or indoor area. The alerts or events may also be transmitted to and stored on relevant building nodes 226 or user nodes 228, such that a subsequent interactions of the relevant node are tracked. The subsequent interaction may then trigger events or alarms in the wireless tracking system, according to some embodiments. For example, if the individual exposed to a contagious disease receives an alert at their user node 228, the user node 228 records that it is exposed. The user node 228 may then transmit additional alerts to other nodes that it interacts with, so that the potential further spread of the contagious disease is tracked. The alert stored on the user node 228 may also trigger locks on doors and equipment, as discussed further below with respect to FIGS. 6B and 6C.

According to some embodiments, the user nodes 228 are configured to automatically interact with the building node 226 every time the user nodes 228 are within a threshold distance from the building node 226. Similarly, the building node 226 are configured to scan the physical premises 236 for the user nodes 228 and always interact with the user nodes 228. This allows for complete end-to-end tracking of the user nodes 228. The threshold distance may correspond to a communication range for the wireless communication mode between the user nodes 228 and the building node 226, according to some embodiments. In some embodiments, the tracked interactions are used to perform contact tracing. For example, if a user node A and a user node B both interact with a building node 226 at the same time or within a threshold amount of time within each other, the wireless tracking system may determine that the user node A and the user node B have been in contact with each other or within proximity to each other. Thus, the wireless tracking system may infer that the users associated with user node A and the user node B have been in contact with each other or within proximity to each other.

A building node 226 and a user node 228 may also track the length of time that a user node 228 are interacting for (i.e., are in communication range of each other). For example, if a user node 228 is in a part of the physical premises 236 that corresponds to an area within the Bluetooth communication range of a building node 226 for a duration of 30 minutes, the building node 226, the user node 228, or both will record the 30-minute duration and store it in their respective memory. The 30-minute duration may be determined based on multiple interactions that occur in sequence and/or within a threshold time from each other, according to some embodiments. In one example, the building node 226 and the user node 228 interact every five minutes in a six-interaction sequence over the 30 minute duration. The wireless tracking system then determines, based on the six interactions, that the user node 228 has been in proximity of the building node 226 for 30 minutes. In another example, the user node 228 interacts with the building node 226 at 1:00 PM and then interacts with the building node 226 again at 1:30 PM. The user node 228 also reports (e.g., to the building node 226 or to the wireless tracking system) and records that the user node 228 has not moved more than a threshold distance or velocity during that time period. The wireless tracking system determines, based at least in part on the two interactions and the stationary conditions reported by the user node 228, that the user node 228 has been in proximity of the building node 226 for 30 minutes. In some contact tracing applications where the duration of interactions is important, the wireless tracking system may issue alerts based on interactions that have durations that are longer than a threshold period of time. Alternatively, the wireless tracking system may issue alerts based on interaction that have durations shorter than a threshold period of time.

Each of the user nodes 228 are also configured to track interactions between itself and other user nodes 228, according to some embodiments. For example, this may be the case in contact tracing applications. In a specific example, the potential spread of a contagious disease may be tracked through contact tracing using the tracked interactions between user nodes 228. Each user node 228 stores the identifier of all other user nodes that it interacts with in a log in its memory. The user node 228 may then uploads the log of interactions to the he distributed network infrastructure 203 (also referred to herein as "the cloud" 203), which stores the log in the database 244. In some embodiments, the user node 228 uploads the log to the cloud 203 when it reaches a building node 226 or intermediate range wireless access point 216 it can wirelessly communicate with. The user node 228 then transmits the log to the building node 226 or the intermediate range wireless access point 216 to be relayed up to the cloud 203. The wireless tracking system then determines any relevant events that occur, based on the tracked interactions between user nodes 228. In some embodiments, if the wireless tracking system determines that any of the users associated with user nodes 228 have violated a protocol for interactions between users, based on the tracked interactions, the wireless tracking system may revoke access rights or authorization for the users and issue appropriate alerts. In an example, if the wireless tracking system determines that a user has been exposed to a contagious disease, the wireless tracking system revokes authorization for a user to enter the physical premises 236. The wireless tracking system may further disable the user node 228 from being able to unlock doors or gates for entry into the physical premises 236.

In some embodiments, the building node 226 is constantly searching for a received ping signal being transmitted from a user node 228. The user node 228, may transmit the ping signal at a frequency (e.g., every 5 minutes) or on a schedule. When the building node 226 receives the ping, it records the interaction and stores it to its memory. The user node 228 may not receive any communication from the building node 226, in further embodiments. This may be done to conserve battery of the user node 228. In this case, only the building node 228 records the interaction. The building node 228 may then upload the recorded interactions to a database 244 of the cloud 203. The interactions and location of the user node 228 may then be tracked in the cloud.

In some embodiments, the user node 228 records and stores interactions with the building node 226. The user node 228 then uploads its stored interactions to the cloud 203. In some embodiments, the user node 228 directly uploads the stored interactions through the network 204. This may occur in cases where the user node 228 includes wireless communications systems for accessing the network 204 such as cellular communication systems or Wi-Fi communications systems. In other embodiments, the user node 228 may upload its stored interactions to the cloud 203 by relaying the data through other nodes of the wireless tracking system. The other nodes of the wireless tracking system may include another user node 228, a building node 226, an intermediate range wireless access point 216, a gateway device node, a client device (e.g., a computer, a laptop, or a smart phone), or some other wireless communication node. The user node 228 may upload its recorded interactions to the cloud 203 in batches. That is, the user node 228 may not upload its recorded interaction to the cloud 203 immediately but may instead wait for an optimal time to upload all stored interactions on its memory. The user node 228 may then delete the stored interactions from its memory after the upload to conserve memory, in further embodiments. In one example, the user node 228 stores the recorded interactions and waits until the user node 228 can connect with a gateway node or intermediate range wireless access point 216 to upload the stored interactions to the cloud 203, by relaying the data through the gateway node or intermediate range wireless access point 216.

FIG. 6B shows an example environment 601 that is an alternate embodiment of the example environment 200 shown in FIG. 6A, according to some embodiments. The example environment 601 is similar to the example environment 200, except that the platform 202 includes one or more ingress/egress nodes 238 that are associated with ingress/egress points for the physical premises 236 or areas of the physical premises 236. Each ingress/egress node 238 is an embodiment of a building node 226 that is placed within a threshold distance of an ingress/egress point. An example of an ingress/egress point is a door or gate into a room or area. By tracking interactions of user nodes 228 passing through the ingress/egress points using the ingress/egress nodes 238 (also referred to herein as simply the "ingress" nodes 238), the wireless tracking system may determine the flow of users in and out of the physical premises or areas of the physical premises.

In some embodiments, each ingress node 238 communicates with an access control system of the physical premises 236. The access control system may be an electronic system for restricting the entry of individuals into areas of the physical premises 236. For example, the access control system may be a lock system for doors in the physical premises 236 that only allows authorized users to unlock the doors. The ingress node 238 may interact with a user node 228 attempting to pass through the associated ingress/egress point (also referred to herein simply as "the ingress" point) and track the interactions. In further embodiments, the ingress node 238 may determine if the user associated with the user node 228 is authorized for entry through the ingress point. If the ingress node 238 determines that the user is not authorized, it may instruct the access control system to deny access to the user. The determination may be based on receiving the log of interactions from the user node 228, according to some embodiments. In some embodiments, based on the received log of interactions, the ingress node 238 may revoke authorization or access rights of the associated user for restricted areas of the physical premises 236. For example, if the tracked interactions show that a user has been exposed to a contagious disease, the user may have his or her access rights revoked.

FIG. 6C shows an example environment 601 that is an alternate embodiment of the example environment 200 shown in FIG. 6A, according to some embodiments. The example environment 601 is similar to the example environment 200, except that the platform 202 includes one or machine nodes 240 that are each associated with a machinery, tool, or equipment (collectively referred to as "a machine" herein) in the physical premises 236. The example environment 601 may also include one or more ingress nodes 238 (not shown in FIG. 6C), according to some embodiments.

A machine node 240 may be an embodiment of a building node 226, according to some embodiments. This may be the case when the associated machine for a machine node 240 is a stationary piece of equipment, for example. In other embodiments, a machine node 240 may be an embodiment of a tape node. This may be the case when the associated machine for the machine node 240 is a mobile piece of equipment, for example. The machine nodes 240 and the user nodes 228 track interactions between each other and upload the tracked interactions up to the cloud 203. The wireless tracking system determines based on the tracked interactions if a user associated a user node 228 operated a machine associated a machine node 240.

In some embodiments, the machine node 240 communicates with the machine. For example, if the machine node 240 includes an access control system that restricts the operation of the machine, the machine may communicate to the machine node 240 to inform it that someone is attempting to operate the machine. The machine node 240, in response, may attempt to interact with a user node 228 in the area around the machine. Further, the machine node 240 may determine if the user attempting to operate the machine is authorized to operate the machine based on the interaction. For example, the machine node 240 may receive a log of interactions from the user node 228 and determine if the user has violated any protocols based on the interactions. Alternatively, the machine node 240 may store a list of authorized users and check that the user node 228 is associated with one of the authorized users. If the user is not authorized or if the machine node 240 determines that the user's access rights should be revoked, the machine node 240 may instruct the machine to shut off, disable certain functions of the machine, or deny operational access to the user.

In some embodiments, the machine node 240 determines that a user has been operating the associated machine based on a duration of time that the associated user node 228 has been in proximity to the machine node. For example, if the user node 228 remains within a threshold distance of the machine node 240 for longer than a minimum amount of time, the machine node 240 determines that the user has operated the associated machine. The machine node may determine the distance of the user node from the machine node 240 based on a received signal strength of a wireless communication signal. For example, the machine node 240 may receive Bluetooth communications or broadcast signals from the user node 228 and determine the distance of the user node 228 based on the received signal strength of the Bluetooth signals. Alternatively, the user node 228 may receive Bluetooth communications or broadcast signals from the machine node 240 and may determine the distance of the machine node 240 from the user node 228 based on the received signal strength of the Bluetooth signals. The user node 228 may then report the determined distance to the machine node 240 via Bluetooth communication. Although Bluetooth is used as an example wireless communication signal for determining distance, other wireless communication signals may similarly be used, such as Wi-Fi, LoRa, other radio frequency (RF) signals, cellular communications, some other wireless communication signal, or some combination thereof. Also, similar techniques may be used to determine the distance between other nodes (e.g., building nodes, user nodes, and ingress nodes) of the wireless tracking system.

Hierarchical Wireless Communications Network

Figure 7:
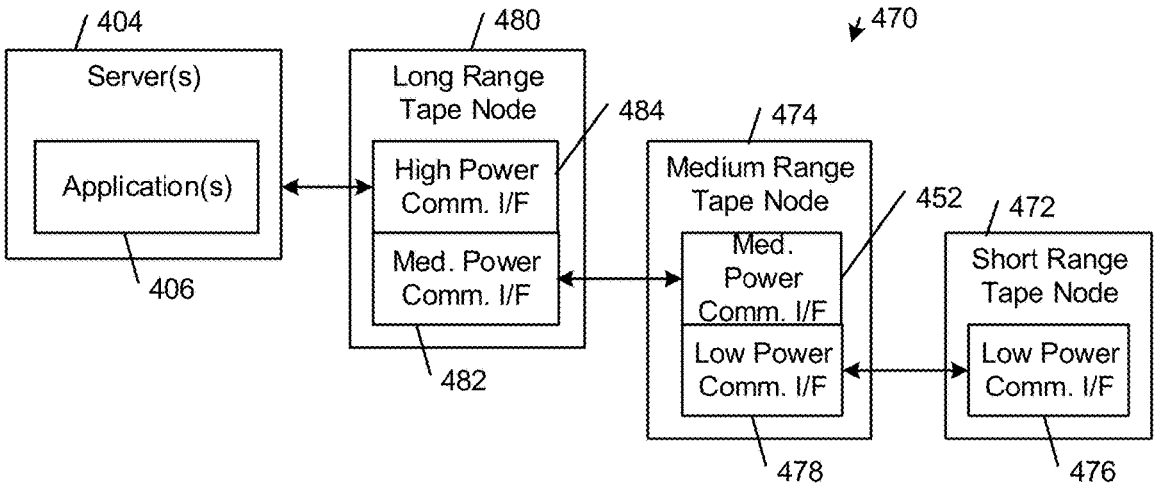
FIG. 7 is a diagrammatic view of a hierarchical communications network, according to some embodiments.

FIG. 7 shows an example hierarchical wireless communications network of tape nodes 470. In this example, the short range tape node 472 and the medium range tape node 474 communicate with one another over their respective low power wireless communication interfaces 476, 478. The medium range tape node 474 and the long range tape node 480 communicate with one another over their respective medium power wireless communication interfaces 478, 482. The long range tape node 480 and the network server 404 communicate with one another over the high power wireless communication interface 484. In some examples, the low power communication interfaces 476, 478 establish wireless communications with one another in accordance with the Bluetooth LE protocol, the medium power communication interfaces 452, 482 establish wireless communications with one another in accordance with the LoRa communications protocol, and the high power communication interface 484 establishes wireless communications with the server 404 in accordance with a cellular communications protocol.

In some examples, the different types of tape nodes are deployed at different levels in the communications hierarchy according to their respective communications ranges, with the long range tape nodes generally at the top of the hierarchy, the medium range tape nodes generally in the middle of the hierarchy, and the short range tape nodes generally at the bottom of the hierarchy. In some examples, the different types of tape nodes are implemented with different feature sets that are associated with component costs and operational costs that vary according to their respective levels in the hierarchy. This allows system administrators flexibility to optimize the deployment of the tape nodes to achieve various objectives, including cost minimization, asset tracking, asset localization, and power conservation.

In some examples, a server 404 of the network service 408 designates a tape node at a higher level in a hierarchical communications network as a master node of a designated set of tape nodes at a lower level in the hierarchical communications network. For example, the designated master tape node may be adhered to a parcel (e.g., a box, pallet, or shipping container) that contains one or more tape nodes that are adhered to one or more packages containing respective assets. In order to conserve power, the tape nodes typically communicate according to a schedule promulgated by the server 404 of the network service 408. The schedule usually dictates all aspects of the communication, including the times when particular tape nodes should communicate, the mode of communication, and the contents of the communication. In one example, the server 404 transmits programmatic Global Scheduling Description Language (GSDL) code to the master tape node and each of the lower-level tape nodes in the designated set. In this example, execution of the GSDL code causes each of the tape nodes in the designated set to connect to the master tape node at a different respective time that is specified in the GSDL code, and to communicate a respective set of one or more data packets of one or more specified types of information over the respective connection. In some examples, the master tape node simply forwards the data packets to the server network node 404, either directly or indirectly through a gateway tape node (e.g., the long range tape node 416 adhered to the mobile vehicle 412 or the long range tape node 414 adhered to an infrastructure component of the environment 400). In other examples, the master tape node processes the information contained in the received data packets and transmits the processed information to the server network node 404.

Figure 8:
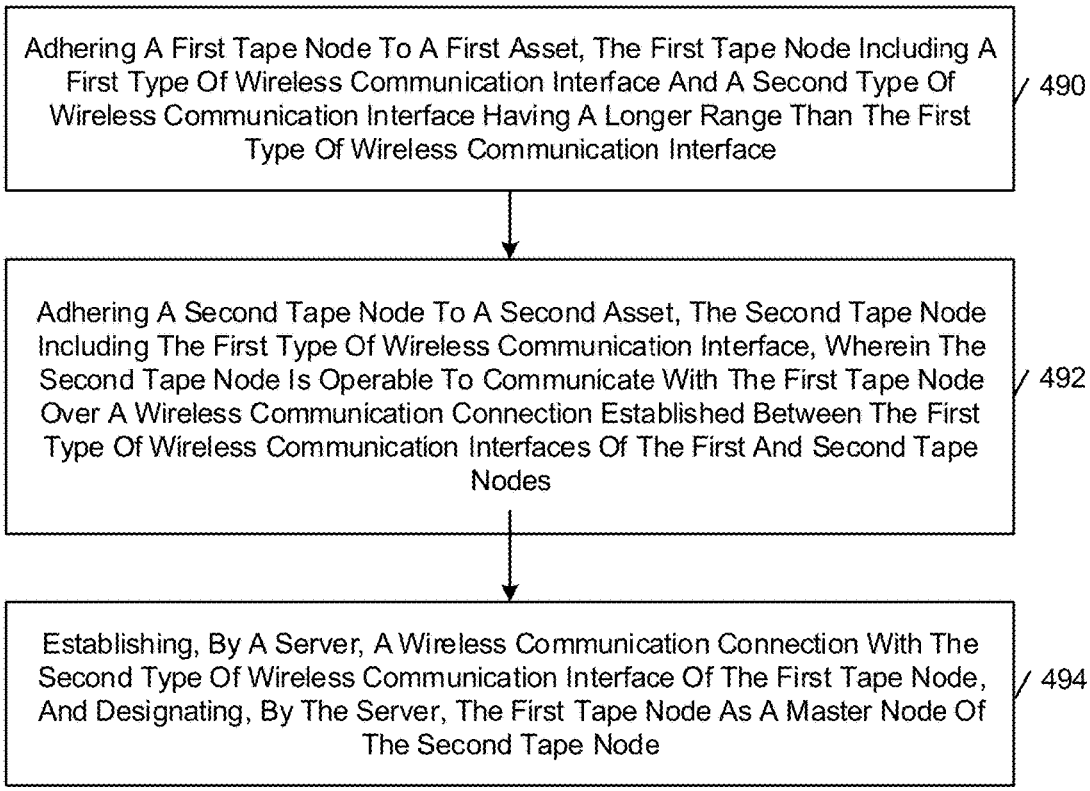
FIG. 8 is a flow diagram of a method of creating a hierarchical communications network, according to some embodiments.

FIG. 8 shows an example method of creating a hierarchical communications network. In accordance with this method, a first tape node is adhered to a first asset in a set of associated assets, the first tape node including a first type of wireless communication interface and a second type of wireless communication interface having a longer range than the first type of wireless communication interface (FIG. 8, block 490). A second tape node is adhered to a second asset in the set, the second tape node including the first type of wireless communication interface, wherein the second tape node is operable to communicate with the first tape node over a wireless communication connection established between the first type of wireless communication interfaces of the first and second tape nodes (FIG. 8, block 492). An application executing on a computer system (e.g., a server 404 of a network service 408) establishes a wireless communication connection with the second type of wireless communication interface of the first tape node, and the application transmits programmatic code executable by the first tape node to function as a master tape node with respect to the second tape node (FIG. 8, block 494).

In some embodiments, the second tape node is assigned the role of the master tape node with respect to the first tape node.

Distributed Agent Operating System

As used herein, the term "node" refers to both a tape node and a non-tape node unless the node is explicitly designated as a "tape node" or a "non-tape node." In some embodiments, a non-tape node may have the same or similar communication, sensing, processing and other functionalities and capabilities as the tape nodes described herein, except without being integrated into a tape platform. In some embodiments, non-tape nodes can interact seamlessly with tape nodes. Each node is assigned a respective unique identifier.

The following disclosure describes a distributed software operating system that is implemented by distributed hardware nodes executing intelligent agent software to perform various tasks or algorithms. In some embodiments, the operating system distributes functionalities (e.g., performing analytics on data or statistics collected or generated by nodes) geographically across multiple intelligent agents that are bound to items (e.g., parcels, containers, packages, boxes, pallets, a loading dock, a door, a light switch, a vehicle such as a delivery truck, a shipping facility, a port, a hub, etc.). In addition, the operating system dynamically allocates the hierarchical roles (e.g., master and slave roles) that nodes perform over time in order to improve system performance, such as optimizing battery life across nodes, improving responsiveness, and achieving overall objectives. In some embodiments, optimization is achieved using a simulation environment for optimizing key performance indicators (PKIs).

In some embodiments, the nodes are programmed to operate individually or collectively as autonomous intelligent agents. In some embodiments, nodes are configured to communicate and coordinate actions and respond to events. In some embodiments, a node is characterized by its identity, its mission, and the services that it can provide to other nodes. A node's identity is defined by its capabilities (e.g., battery life, sensing capabilities, and communications interfaces). A node's mission (or objective) is defined by the respective program code, instructions, or directives it receives from another node (e.g., a server or a master node) and the actions or tasks that it performs in accordance with that program code, instructions, or directives (e.g., sense temperature every hour and send temperature data to a master node to upload to a server). A node's services define the functions or tasks that it is permitted to perform for other nodes (e.g., retrieve temperature data from a peripheral node and send the received temperature data to the server). At least for certain tasks, once programmed and configured with their identities, missions, and services, nodes can communicate with one another and request services from and provide services to one another independently of the server.

Thus, in accordance with the runtime operating system every agent knows its objectives (programmed). Every agent knows which capabilities/resources it needs to fulfill objective. Every agent communicates with every other node in proximity to see if it can offer the capability. Examples include communicate data to the server, authorize going to lower power level, temperature reading, send an alert to local hub, send location data, triangulate location, any boxes in same group that already completed group objectives.

Nodes can be associated with items. Examples of an item includes, but are not limited to for example, a package, a box, pallet, a container, a truck or other conveyance, infrastructure such as a door, a conveyor belt, a light switch, a road, or any other thing that can be tracked, monitored, sensed, etc. or that can transmit data concerning its state or environment. In some examples, a server or a master node may associate the unique node identifiers with the items.

Communication paths between tape and/or non-tape nodes may be represented by a graph of edges between the corresponding assets (e.g., a storage unit, truck, or hub). In some embodiments, each node in the graph has a unique identifier. A set of connected edges between nodes is represented by a sequence of the node identifiers that defines a communication path between a set of nodes.

Figure 9A:
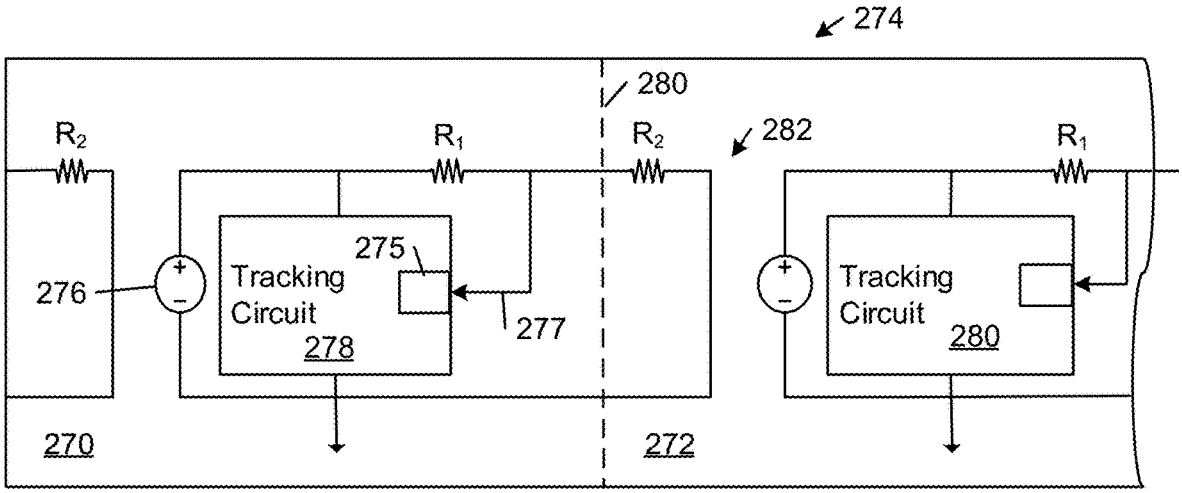
FIGS. 9A-9C are diagrammatic top views of a length of an example tracking adhesive product, according to some embodiments.

Referring to FIG. 9A, in some examples, each of one or more of the segments 270, 272 of a tracking adhesive product 274 includes a respective circuit 275 that delivers power from the respective energy source 276 to the respective tracking circuit 278 (e.g., a processor and one or more wireless communications circuits) in response to an event. In some of these examples, the wake circuit 275 is configured to transition from an off state to an on state when the voltage on the wake node 277 exceeds a threshold level, at which point the wake circuit transitions to an on state to power-on the segment 270. In the illustrated example, this occurs when the user separates the segment from the tracking adhesive product 274, for example, by cutting across the tracking adhesive product 274 at a designated location (e.g., along a designated cut-line 280). In particular, in its initial, un-cut state, a minimal amount of current flows through the resistors $R_1$ and $R_2$. As a result, the voltage on the wake node 270 remains below the threshold turn-on level. After the user cuts across the tracking adhesive product 274 along the designated cut-line 280, the user creates an open circuit in the loop 282, which pulls the voltage of the wake node above the threshold level and turns on the wake circuit 275. As a result, the voltage across the energy source 276 will appear across the tracking circuit 278 and, thereby, turn on the segment 270. In particular embodiments, the resistance vale of resistor $R_1$ is greater than the resistance value of $R_2$. In some examples, the resistance values of resistors $R_1$ and $R_2$ are selected based on the overall design of the adhesive product system (e.g., the target wake voltage level and a target leakage current).

In some examples, each of one or more of the segments of a tracking adhesive product includes a respective sensor and a respective wake circuit that delivers power from the respective energy source to the respective one or more of the respective tracking components 278 in response to an output of the sensor. In some examples, the respective sensor is a strain sensor that produces a wake signal based on a change in strain in the respective segment. In some of these examples, the strain sensor is affixed to a tracking adhesive product and configured to detect the stretching of the tracking adhesive product segment as the segment is being peeled off a roll or a sheet of the tracking adhesive product. In some examples, the respective sensor is a capacitive sensor that produces a wake signal based on a change in capacitance in the respective segment. In some of these examples, the capacitive sensor is affixed to a tracking adhesive product and configured to detect the separation of the tracking adhesive product segment from a roll or a sheet of the tracking adhesive product. In some examples, the respective sensor is a flex sensor that produces a wake signal based on a change in curvature in the respective segment. In some of these examples, the flex sensor is affixed to a tracking adhesive product and configured to detect bending of the tracking adhesive product segment as the segment is being peeled off a roll or a sheet of the tracking adhesive product. In some examples, the respective sensor is a near field communications sensor that produces a wake signal based on a change in inductance in the respective segment.

Figure 9B:
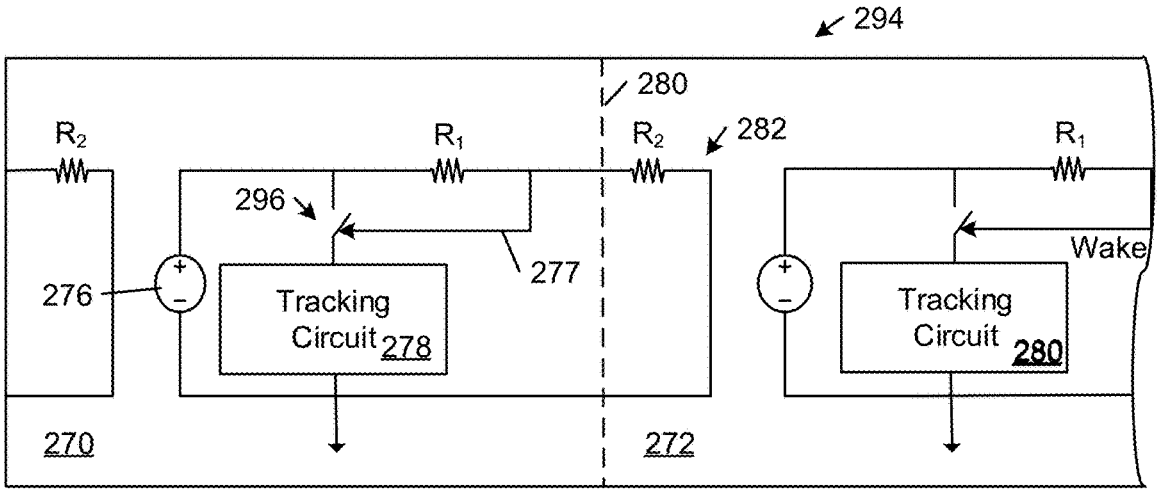

FIG. 9B shows another example of a tracking adhesive product 294 that delivers power from the respective energy source 276 to the respective tracking circuit 278 (e.g., a processor and one or more wireless communications circuits) in response to an event. This example is similar in structure and operation as the tracking adhesive product 294 shown in FIG. 9A, except that the wake circuit 275 is replaced by a switch 296 that is configured to transition from an open state to a closed state when the voltage on the switch node 277 exceeds a threshold level. In the initial state of the tracking adhesive product 294, the voltage on the switch node is below the threshold level as a result of the low current level flowing through the resistors $R_1$ and $R_2$. After the user cuts across the tracking adhesive product 294 along the designated cut-line 280, the user creates an open circuit in the loop 282, which pulls up the voltage on the switch node above the threshold level to close the switch 296 and turn on the tracking circuit 278.

Figure 9C:
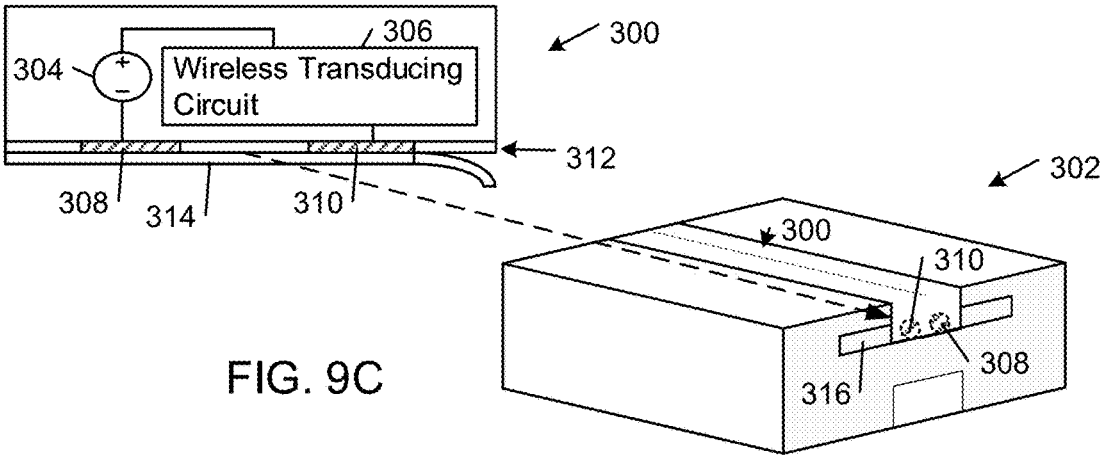

FIG. 9C shows a diagrammatic cross-sectional front view of an example adhesive tape platform 300 and a perspective view of an example asset 302. Instead of activating the adhesive tape platform in response to separating a segment of the adhesive tape platform from a roll or a sheet of the adhesive tape platform, this example is configured to supply power from the energy source 302 to turn on the wireless transducing circuit 306 in response to establishing an electrical connection between two power terminals 308, 310 that are integrated into the adhesive tape platform. In particular, each segment of the adhesive tape platform 300 includes a respective set of embedded tracking components, an adhesive layer 312, and an optional backing sheet 314 with a release coating that prevents the segments from adhering strongly to the backing sheet 314. In some examples, the power terminals 308, 310 are composed of an electrically conductive material (e.g., a metal, such as copper) that may be printed or otherwise patterned and/or deposited on the backside of the adhesive tape platform 300. In operation, the adhesive tape platform can be activated by removing the backing sheet 314 and applying the exposed adhesive layer 312 to a surface that includes an electrically conductive region 316. In the illustrated embodiment, the electrically conductive region 316 is disposed on a portion of the asset 302. When the adhesive backside of the adhesive tape platform 300 is adhered to the asset with the exposed terminals 308, 310 aligned and in contact with the electrically conductive region 316 on the asset 302, an electrical connection is created through the electrically conductive region 316 between the exposed terminals 308, 310 that completes the circuit and turns on the wireless transducing circuit 306. In particular embodiments, the power terminals 308, 310 are electrically connected to any respective nodes of the wireless transducing circuit 306 that would result in the activation of the tracking circuit 306 in response to the creation of an electrical connection between the power terminals 308, 310.

In some examples, after a tape node is turned on, it will communicate with the network service to confirm that the user/operator who is associated with the tape node is an authorized user who has authenticated himself or herself to the network service 54. In these examples, if the tape node cannot confirm that the user/operator is an authorized user, the tape node will turn itself off.

Tracking Interactions

Figure 10A:
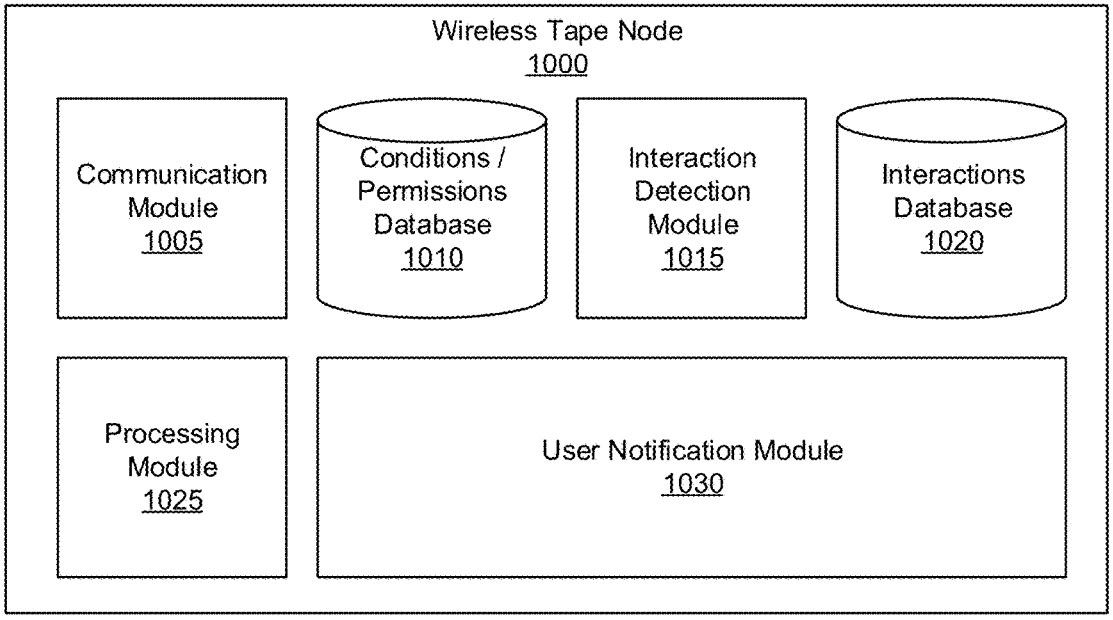
FIG. 10A is an example architecture of a wireless tape node operating in a wireless tracking system, according to some embodiments.

FIG. 10A is an example architecture of a wireless tape node operating in a wireless tracking system, according to some embodiments. The wireless tape node 1000 may be an example of a user node 228, shown in FIGS. 6A-6C, according to some embodiments. As shown in FIG. 10A, the architecture of the wireless tape node comprises a communication module 1005, a conditions/permissions database 1010, an interaction detection module 1015, an interactions database 1020, a processing module 1025, and a user notification module 1030. In some embodiments, the wireless tape node comprises additional, fewer, or other modules.

The communication module 1005 includes one or more wireless communication systems for communicating with other wireless nodes in the wireless tracking system, including, for example, other tape nodes associated with other assets in the wireless tracking system; gateway nodes; user nodes 228; building nodes 226; ingress nodes 238; machine nodes 240; and a cloud 203 or servers of the wireless tracking system.

The communication module 1005 is configured to receive incoming communications in certain modes of operation, to transmit outgoing communications in certain modes of operation, and both receive and transmit communications in certain modes of operation. In some embodiments, the communication module 1005 is configured to receive sensor data describing environmental conditions of an asset corresponding to the tape node and to operate in a particular mode of operation based at least in part on the sensor data. For example, the communication module 1005 receives accelerometer data corresponding to an asset or user being at a standstill for more than a threshold period of time (e.g., 5 minutes) and enters a sleep mode wherein it transmits outgoing communications and does not receive incoming communications. Responsive to receiving accelerometer data corresponding to the asset being in motion, or experiencing more than a threshold amount of movement, the communication module 1005 enters an active mode where it transmits and receives communications.

In some embodiments, wireless tape node 1000 may transmit and/or receive data based on sleep and active modes in order to reduce battery use. The sleep mode may be activated in response to detecting that the wireless node 1000 is not in a condition to experience new interactions. For example, if the wireless tape node 1000 detects that it has been stationary for a threshold period of time (e.g., 5 minutes), the wireless node may enter the sleep mode. In the sleep mode, if the wireless tape node detects that it is moving, the wireless tape node may exit the sleep mode and enter or re-enter an active mode, according to some embodiments. The wireless tape node 1000 may remain in the active mode for a threshold period of time (e.g., 10 min), before it is allowed to re-enter the sleep mode again. In further embodiments, the wireless tape node 100 may detect motion or stationary conditions based on accelerometer data from an accelerometer sensor integrated with the wireless tape node 1000. In other embodiments, the sleep mode and active modes may be triggered by different conditions. For example, the sleep mode or the active mode may be triggered when the wireless tape node 1000 enters a specific area in an environment. In other embodiments, the sleep mode or active mode may be triggered during different times of the day, according to a schedule. In some embodiments, the sleep mode or active mode may be triggered by an event detected by the wireless tracking system.

In some embodiments, while in the sleep mode, the wireless tape node 1000 is configured to only transmit wireless communication signals and not receive wireless communication signals for tracking interactions. Thus, if another wireless tape node that is in motion or in the active mode passes nearby, the other wireless tape node will receive the wireless communication signal from the wireless tape node 1000 that is in the sleep mode. The other wireless tape node will track the interaction and upload the interaction to the cloud at some point in time. Even if the wireless tape node 1000 in the sleep mode does not record the interaction, the other wireless tape node will record it and report it up to the wireless tracking system.

When a communication module 1005 interacts with another wireless node in the wireless tracking system, at least one node in the set of interacting nodes provides one or more of the following information: A unique identifier of the respective wireless node; an identifier of an asset (e.g., a user, a building, a location, a machine, or ingress point) associated with the node; a start time and end time of the interaction; a duration of the interaction, a measure of proximity between the set of nodes; location data for one of the respective nodes, an event or condition status for the associated asset, authentication information for an associated user, or some other information relevant to the interaction.

The communication module 1005 is further configured to transmit and receive communications with other entities of the wireless tracking system. The communication module 1005 may upload, in real-time, near-real time, or periodically (e.g., as per a scheduled transmission), interaction information to a gateway node, a client device, cloud, or server of the wireless tracking system. The communication module 1005 may receive, from a gateway node, client device, cloud, or server of the wireless tracking system, a notification of a contamination event, an unauthorized interaction event, or some other event having occurred. The notification may further include an instruction to the communication module 1005 to transmit notifications to users or operators of the asset corresponding to the tape node.

The conditions/permissions database 1010 (also referred to herein as simply the "permissions database" 1010) stores information describing conditions for interactions between tape nodes in the environment to be stored. In some embodiments, the conditions/permissions database 1010 further comprises permissions for users of the wireless tracking system to interact with certain assets or to enter or exit certain areas of the environment. The tape node 1000 may transmit permissions information for the associated user from the permissions database 1010 to other wireless nodes of the wireless tracking system. For example, the tape node 1000 may communicate access rights or authorization for an associated user from the permission database 1010 to a building node 226, an ingress node 238, or a machine node 240, according to some embodiments.

Conditions for interaction may comprise one or more of the following: Threshold minimum time for an interaction; threshold maximum distance between interacting tape nodes; requirements for sensor data corresponding to the interaction (e.g., an interaction is only registered and stored if it occurs within an area having greater than a threshold temperature if survival of disease is unlikely to occur at low temperatures); requirements for machinery to be operational (e.g., powered on, registering a minimum action); or some other condition for an interaction. If an interaction violates one of the conditions in the permissions database 1010, the tape node 1000 may determine that a protocol has been violated. The tape node 1000 may then transmit an alert to other nodes of the wireless tracking system, as also described above with respect to FIGS. 6A-6C. In some embodiments, the tape node 1000 transmits an alert to a client device (e.g., a smart phone) also associated with the user of the tape node 1000 that notifies them of the violation. For example, if the tape node 1000 detects an interaction with another tape node (e.g., another user node 228) that lasts longer than a threshold period of time as allowed by a protocol for person-to-person interactions, the tape node 1000 may send an alert to each of the users' smartphones instructing them to end the interaction.

Permissions information may comprise one or more of the following: User permissions to interact with, operate, or power on machinery or other assets in the environment; user permissions to enter an area in the environment; user permissions to exit an area in the environment; user permissions to move between areas of an environment in succession or without performing one or more intermediate steps (e.g., decontamination); user permissions to open a door, gate, safe, or other container; user permissions to move an asset; user permissions to interact with another user; or some other permission relevant to users in a restricted environment. Building nodes 226, ingress nodes 238, machine nodes 240, or some combination thereof may deny or grant access to a user to perform certain actions based on the permissions information. Thus, authorized and unauthorized actions and movement of a user in a restricted environment can be tracked by the wireless tracking system.

The interaction detection module 1015 receives information describing communications with other tape nodes in the environment from the communication module 1005 and determines whether the communications satisfy corresponding conditions in the conditions/permissions database 1010. Responsive to a communication satisfying the conditions in the database 1010, the interaction detection module 1015 stores information describing the interaction in the interactions database 1020.

Figure 10B:
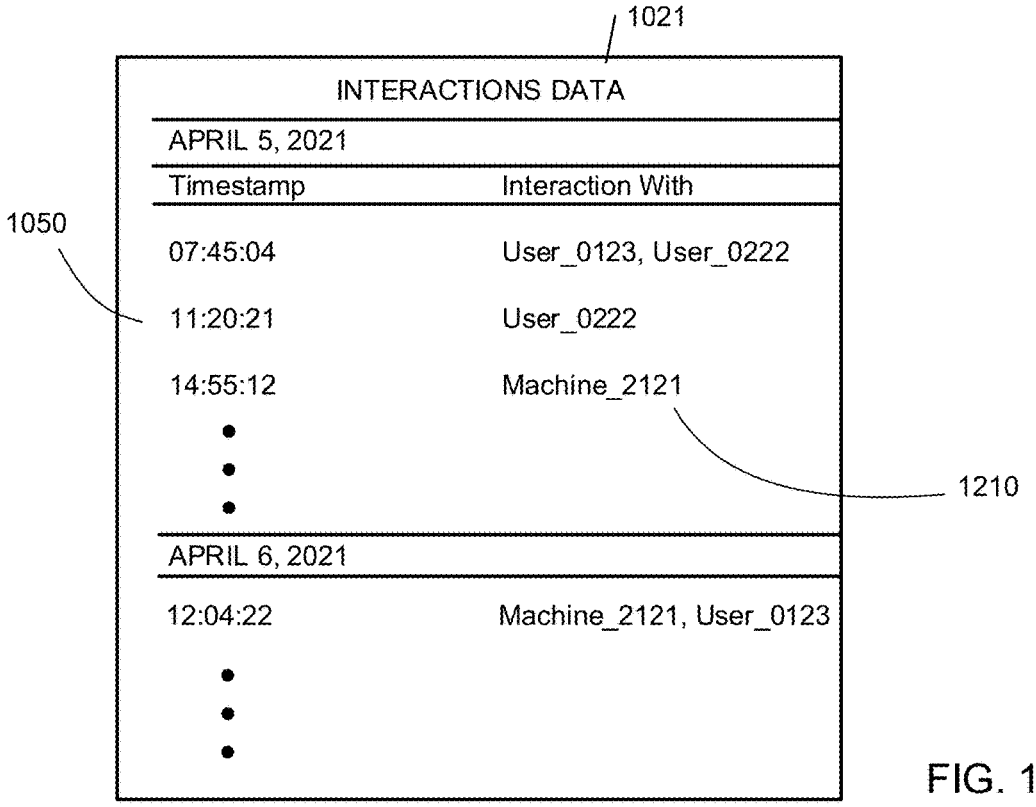
FIG. 10B is an example of a data table of interactions captured by the wireless tape node stored of FIG. 10A in the interactions database, according to some embodiments.

The interactions database 1020, further described in conjunction with FIG. 10B, stores information describing detected interactions of the tape node 1000. Interaction information for an interaction may include one or more of the following: One or more identifiers for other wireless nodes participating in the interaction; a timestamp of an interaction; an asset corresponding to the one or more wireless nodes; one or more conditions of the interaction (e.g., a duration and proximity of the interaction); permission information received from another wireless node; permission information retrieved from the tape node's 1000 own permissions database 1010; sensor data relevant to the interaction; or any other information relevant to an interaction. The interactions database 1020 may store the interaction information in a data table, according to some embodiments. An example of a data table is shown in FIG. 10B, according to some embodiments.

The processing module 1025 performs computations, processing, and/or one or more analyses on the interactions information and detects when events occur. Events may comprise, for example, machinery breaking during use, machinery performing abnormally during use, potential contamination or spread of an illness or other dangerous compound, unauthorized entry into an area, unauthorized use of a machine, or some other event that may be detected in a restricted environment.

The user notification module 1030 is configured to coordinate the transmission of notifications to a user of the tape node 1000 (e.g., via a client device), the wireless tracking system, another tape node, or some other wireless node of the wireless tracking system. The notification may be in response to the tape node 1000 detecting an event that may impact the restricted environment. For example, the notification may be in response to a violation of a protocol for the restricted environment. Optionally, in some embodiments, the tape node 1000 includes a display (not shown) for displaying notifications to a user, according to some embodiments. The display may be an LED indicator, for example. In other embodiments, the display is a flexible display, such as a flexible OLED display panel.

FIG. 10B is an example of a data table 1021 of interactions captured by the wireless tape node 1000 stored in the interactions database 1020, according to some embodiments. The interactions data table 1021 is a log of interactions of the wireless tape node 1000. The data table 1021 comprises timestamps 1050 of interactions and identifiers 1210 of wireless nodes that have participated in the interactions. The data table 1021 is a record of tracked interactions for the wireless tape node 1000 that can be accessed by other wireless nodes of the wireless tracking system to perform end-to-end tracking of the wireless tape node 1000. The end-to-end tracking may be implemented, for example, in contact tracing applications. The end-to-end tracking may also be used for security applications, access control applications, user activity auditing, or any other application where end-to-end tracking of a user or asset is valuable. In further embodiments, the data table 1021 may also include location data (not shown) corresponding to the location of the participating wireless node 1210 at the time of each interaction. Thus the location of the wireless tape node 1000 and the locations of nodes participating in the interactions may be tracked by the wireless tape node.

Portions of the entirety of the interactions data table 1021 may be transmitted to other wireless nodes of the wireless tracking system. For example, the wireless tape node 1000 may transmit the data table 1021 to a building node 226 when it interacts with the building node 226. In some embodiments, the wireless tape node 1000 transmits the data table 1021 for upload to the cloud 203 or a server of the wireless tracking system. The data table 1021 may be relayed through various wireless nodes of the wireless tracking system that subsequently upload it to a database of the cloud 203 via a network connection (e.g., the internet). In some cases, the wireless tape node 1000 is configured to directly send the data table 1021 to the cloud 203 via a cellular communication system of the communication module 1005 or via another wide area network connection. In further embodiments, the wireless tape node 1000 may delete portions of the data table 1021 that have been uploaded to the cloud 203, to conserve storage space in its memory. In other embodiments, the wireless tape node 1000 deletes entries in the data table 1021 that are not of interest to the wireless tracking system for an application. For example, the wireless tape node 1000 may be configured to delete entries that are not relevant to any protocol violations.

Figure 10C:
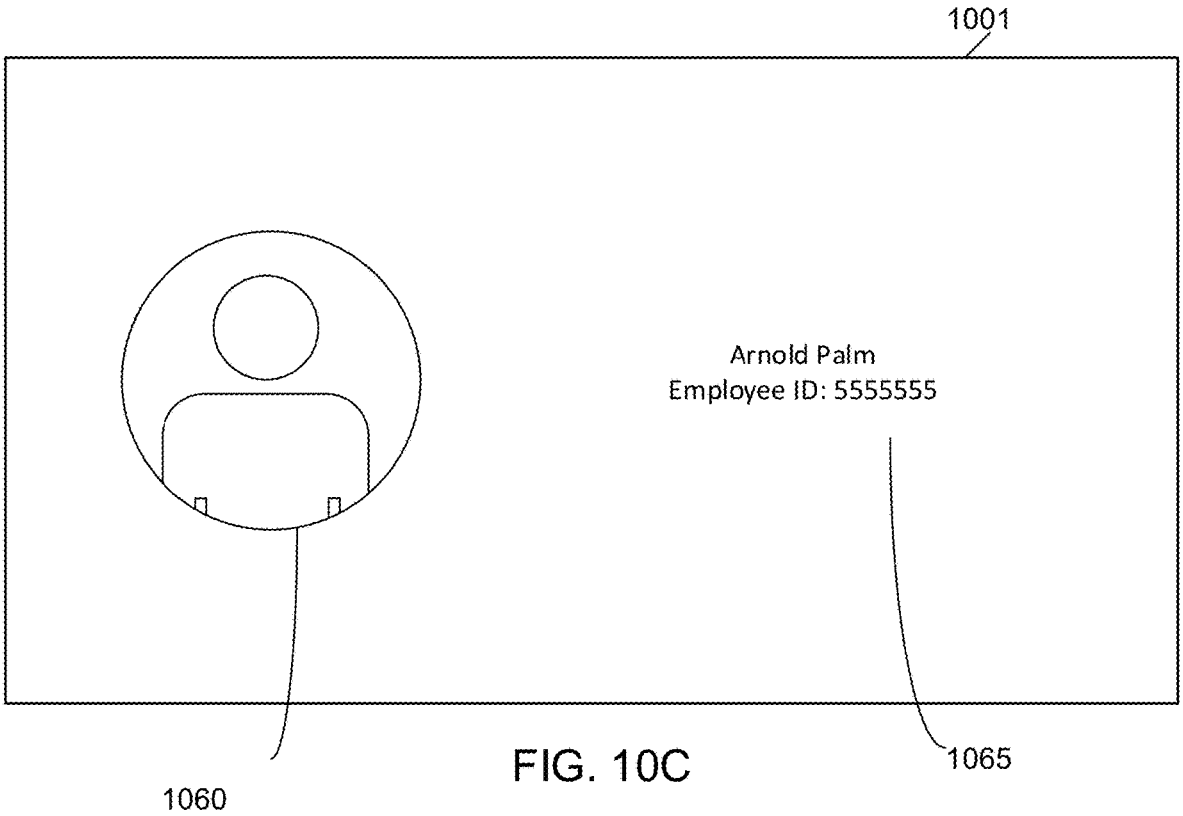
FIG. 10C shows a smart badge that is an embodiment of the wireless tape node shown in FIG. 10A, according to some embodiments.

FIG. 10C shows a smart badge 1001 that is an embodiment of the wireless tape node 1000, according to some embodiments. The smart badge 1001 is in the form of an identification card. In some embodiments, the smart badge 1001 is not fully flexible. In some embodiments, the smart badge 1001 is rigid. The smart badge internally includes the components of the wireless tape node 1000 shown in FIG. 10A. The smart badge may optionally have graphics and information printed on the smart badge. In the example of FIG. 10C, the smart badge includes an identification photograph 1060 of an associated user and personal identification information (PII) 1065 printed on the smart badge. In other embodiments, the smart badge may not have any PII or photographs of the associated user printed on it. The size of the smart badge may be similar to a US driver's license, in some embodiments. For example the smart badge 1001 may have a width less than or equal to 100 millimeters, a height less than or equal to 65 millimeters, and a thickness less than or equal to 1 millimeter. The smart badge 1001 may be able to fit inside of a wallet or a sleeve for carrying an identification card. Thus, a user may easily carry the smart badge 1001 and have their interactions with other users (carrying similar smart badges or other user nodes) and other wireless nodes of the wireless tracking system, without any manual input or actions from the user.

Figure 10D:
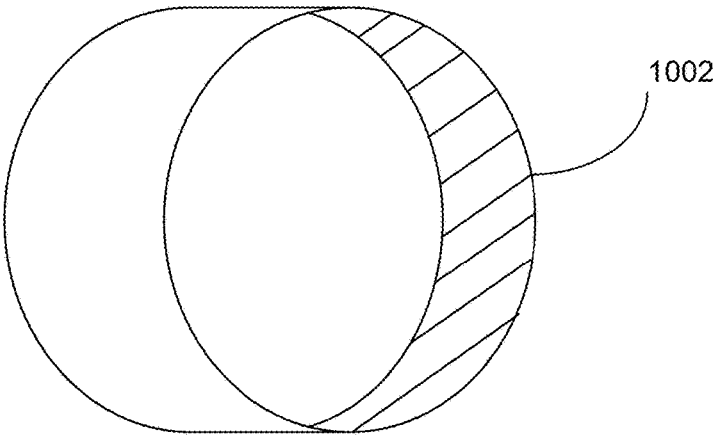
FIG. 10D shows an example wearable device that is an embodiment of the wireless tape node shown in FIG. 10A that may be used as a user node in the wireless tracking system, according to some embodiments

FIG. 10D shows an example wearable device 1002 that is an embodiment of the wireless tape node 1000 that may be used as a user node 228 in the wireless tracking system, according to some embodiments. The wearable device 1002 is configured to be worn around a body part of a user (e.g., a wrist or neck of the user). The wearable device 1002 is a flexible electronic device having a structure similar to that of the adhesive tape platform shown in FIGS. 5A-5C, according to some embodiments. In some embodiments, the wearable device 1002 is an embodiment of a disposable adhesive tape platform, having a form factor similar to that of a paper wristband. Thus, the user may easily wear the wearable device 1002 and 1001 and have their interactions with other users (carrying similar smart badges, wearable devices, or other user nodes) and other wireless nodes of the wireless tracking system, without any manual input or actions from the user.

Figure 11A:
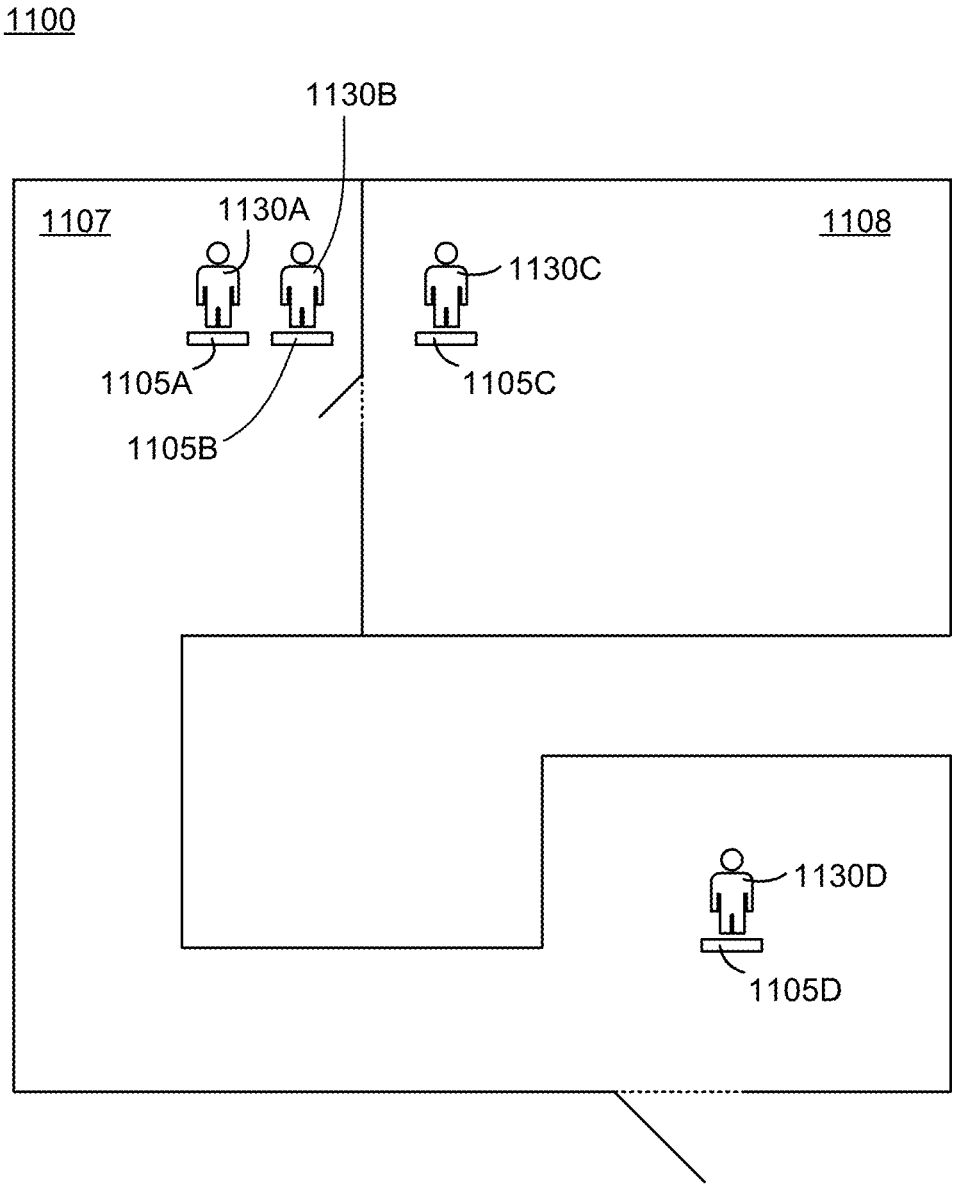
FIGS. 11A-11C are example interactions in an environment 1100 of a wireless tracking system, according to some embodiments
Figure 11B:
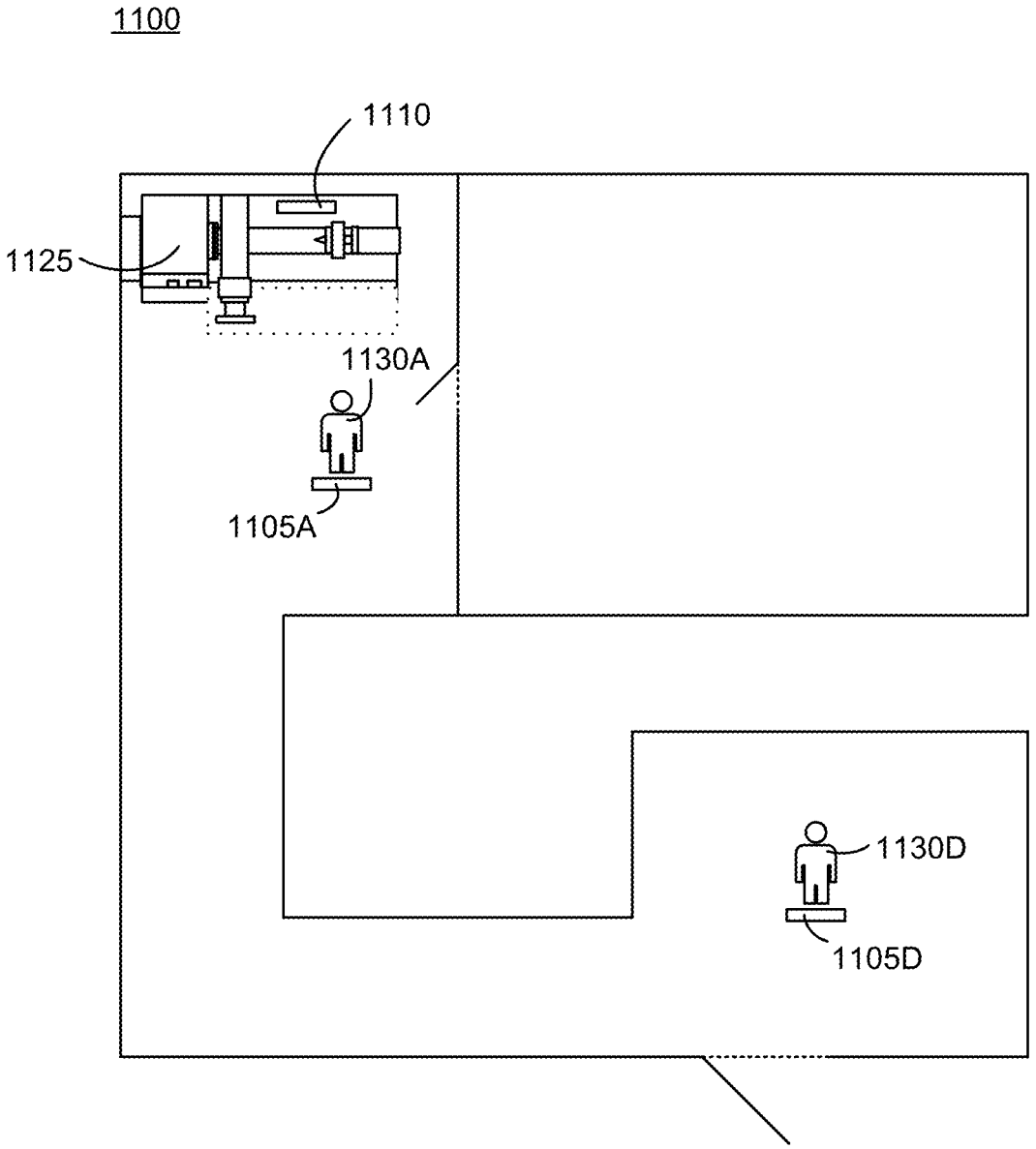
Figure 11C:
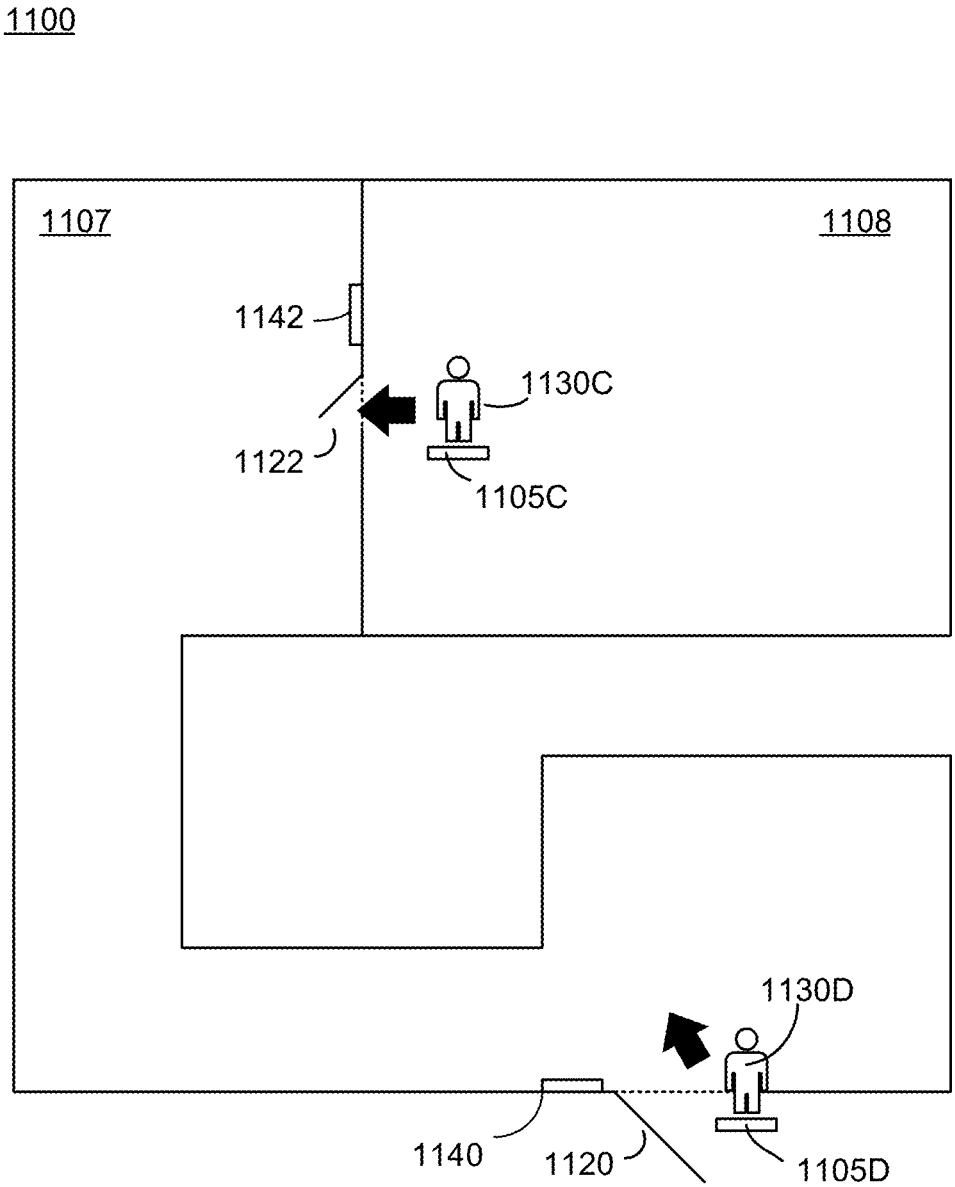

FIGS. 11A-11C are example interactions in an environment 1100 of a wireless tracking system, according to some embodiments. The examples of FIGS. 11A-11C show interactions that occur in an indoor area, but the disclosed method and system thereof of tracking interactions is not limited thereto. The interaction tracking may be used for various applications including security applications, contact-tracing applications, disease exposure applications, hazardous chemical exposure applications, hazardous conditions tracking applications, productivity tracking applications, asset flow tracking applications, traffic monitoring applications, industrial IOT applications, some other applications, or some combination thereof.

FIG. 11A is a diagram illustrating example interactions between users 1130A-D in an example environment 1100, wherein each user has a corresponding user node 1105A-D. The user nodes 1105A-D are each an embodiment of the user node 228. Further, the user nodes 1105A-D may each be an embodiment of the wireless tape node 1000. A first user 1130A and a second user 1130B have an encounter in a first area of the environment, initiating communication between the respective user nodes 1105A, 1105B. Because the encounter satisfies one or more conditions of an interaction, e.g., the user nodes 1105A, 1105B detecting a distance of less than 6 ft between the first user 1130A and the second user 1130B, the tape nodes store information describing the interaction in their respective memories. Although in the above example a threshold distance of 6 ft is used, a different threshold distance may be used for the condition of the interaction. Also, other conditions may be used for determining whether an interaction should be recorded or tracked. For example, the duration of time that the user nodes 1105A and 1105B are in proximity for each other may be a factor for a condition. If the duration of time is greater than a threshold period of time (e.g., 3 minutes), the tape nodes store information for the interaction in their respective memories.

While two user nodes may interact with each other, the wireless tracking system may determine that the users associated with the two user nodes have not physically interacted. In the example of FIG. 11A, the second user 1130B and a third user 1130C do not experience a physical interaction, despite being within a threshold distance of each other. Because they are in different areas of the environment, i.e. different rooms or enclosed spaces, with the second user 1130B being in the first area 1107 and the third user 1130C being in a second area 1108 that is non-contiguous with the first area 1107, the tape nodes 1105B, 1105C may be able to establish a communication, but determine that no interaction occurs and do not store information about the communication. In some embodiments, a gateway node in the first area 1107 communicates with the second user node 1105B and informs the second user node 1105B that it is in the first area 1107. Similarly, a gateway node in the second area 1008 communicates with the third user node 1105C and informs the third user node 1105C that it is in the second area 1108. Thus, the wireless tracking system is able to use additional information, such as the physical layout of the environment, to determine whether physical interactions have occurred for assets or users. In some embodiments, the additional information includes sensor information from sensors integrated into one or more wireless nodes or sensors present in the environment 1100. For example, the user nodes 1105A-D may include integrated sensors. Similarly, the machine node 1110 in FIG. 11B, and the ingress nodes 1140, 1142 in FIG. 11C may include integrated sensors. The sensors may include, for example, cameras, light sensors, thermal sensors, temperature sensors, chemical sensors, electromagnetic field sensors, acoustic sensors, other types of sensors, or some combination thereof.

In general, a wireless node of the wireless tracking system may store information on the environment of the wireless node. In some embodiments, some combination of the building nodes 226, the ingress nodes 238, the machine nodes 240, the ingress nodes 1140, 1142, and the machine node 1110 store information on their respective environment and physical premises on their respective memories. The information may include a physical layout of a building or area, a geographical location of the environment, a type of environment (e.g., a hospital setting, a warehouse setting, etc.), or other information on the environment. Similarly, the wireless tracking system may store this information on a server (e.g., server 244) in the cloud. A wireless node may access the information on the environment when tracking its interactions, in order to determine the occurrence of events or protocol violations, as described above.

A fourth user 1130D is in the same contiguous area, i.e., the first area 1107, as the first and second users 1130A, 1130B, but does not satisfy one or more conditions for an interaction, e.g., the user is more than a threshold distance apart from the first and second users. As such, no interaction between the fourth user 1130D and the other users (1130A-C) is detected or stored, according to some embodiments.

FIG. 11B is diagram illustrating example interactions between users 1130A, 1130D and machinery 1125 in the example environment 1100, wherein each user 1130A, 1130D is carrying a respective user node 1105A, 1105D and the machinery 1125 (also referred to herein as the "machine" 1125) has a corresponding machine node 1110 within a threshold distance from the machine 1125. The machine node 1110 is an embodiment of the machine node 1140, according to some embodiments. Further, the machine node 1110 may be either an embodiment of a gateway node device or a wireless tape node, such as the wireless tape node 1000. The first user 1130A operates the machinery 1125. The corresponding nodes 1105A, 1110 establish a communication connection during operation of the machinery 1125 and determines that the interaction satisfies one or more conditions, such as, for example, the first user 1130A being in proximity of the machinery for more than a threshold amount of time, the machinery 1125 being powered on during the interaction, and the like. The tape nodes 1105A, 1110 store information describing the interaction.

In some embodiments, the machine 1125 communicates with the machine node 1110. The machine 1125 may notify the machine node 1110 that the machine 1125 is being operated. In response, the machine node 1110 may check the local environment for any user nodes that are present. Thus, the machine node 1110 may determine that the user 1130A is using the machine 1125 based on both receiving the notification from the machine node and on an interaction recorded between the machine node 1110 and the user node 1105A. In further embodiments, the machine 1125 may alter its operation or functions in response to receiving instructions from the machine node 1110. For example, the machine node 1110 may detect that the user node 1105A is not associated with a user that is authorized to operate the machine 1125. The machine node 1110 may then communicate instructions to abort operations of the machine 1125. The machine 1125, in response to receiving the instructions, may cease certain functions or operations of the machine 1125.

In some embodiments, the machine node 1110 is integrated with the machine itself 1125. For example, the machine 1125 may have an integrated wireless communications platform that includes the machine node 1110.

A second user 1130D is in the same environment as the first user 1130A and the machinery 1125, but does not satisfy one or more conditions of an interaction, e.g., being more than a threshold distance away from the machinery. As such, no interaction is detected or stored.

In some embodiments, the machine node 1110 is configured to detect multiple users interacting with the machine 1125 or in proximity to the machine 1125. This may be useful in cases where having multiple users near the machine 1125 during its operation violates protocols. For example, safety protocol may require that only one user operate the machine 1125 at a time. The machine node 1110 may detect the violations and issue alerts and instructions to other nodes of the wireless tracking system and the machine 1125, accordingly.

FIG. 11C is a diagram illustrating interactions between users 1130C-D and ingress/egress points 1120, 1122 (also referred to simply as "ingress points" 1120, 1122) in the example environment 11100, according to some embodiments. Each ingress point 1120, 1122 includes a respective associated ingress node 1140, 1142. Each ingress node 1140, 1142 is an embodiment of an ingress node 1138, according to some embodiments. Further, each ingress node 1140, 1142 may be an embodiment of a gateway node device or a wireless tape node, such as the wireless tape node 1000. Each user 1130C-D carries a user node 1130C-1130D.

The user nodes 1130C-1130D and the ingress nodes 1140, 1142 are configured to track interactions between each other, as also described above with respect to FIG. 6B. As user 1130D passes through the ingress point 1120 into the first area 1107, the user node 1105D interacts with the ingress node 1140. The user node 1105D and the ingress node 1140 each store information on the interaction in their respective memories. Based on the interaction, the wireless tracking system, including the ingress node 1140 and the user node 1105D, may determine that the user 1130D has entered the first area 1107.

The direction of flow for the user 1130D into our out of the first area 1107 may be determined in part by additional information gathered by the wireless tracking system. For example, multiple building nodes and/or ingress nodes in the vicinity of the ingress point 1120 may be used to determine or triangulate the position of the user node 1105D based on received signal strength of wireless communication signals from or to the user node 1105D. The position of the user node may be used to determine if the user 1130D has fully entered the first area 1107 or has simply passed by, in some instances. Similarly, the position of the user node 1105D may be used to determine if the user 1130 has exited the first area 1107 through the ingress node, for example, by detecting that the received signal strength from the user node 1105D has a continuously decreasing trend. Further details on determining the flow of wireless nodes through ingress points may be found, for example, in U.S. Provisional Patent Application No. 63/087,304, filed on Oct. 5, 2020, which is hereby incorporated by reference in its entirety. In other examples, the history of interactions of the user node 1105D may be used. More specifically, if the user node 1105D has previously interacted with the ingress node 1140 within a threshold amount of time, the wireless tracking system may determine that a present interaction between the user node 1105D and the ingress node 1140 is associated with the user 1130D exiting the first area 1107 through the ingress point 1120.

Similarly a user 1130C may pass through the ingress point 1122 from the second area 1108 into the first area 1107, during which the user node 1105C interacts with the ingress node 1142. The user node 1105C and the ingress node 1142 store information on the interaction in their respective memories. The wireless tracking system, including the ingress node 1142 and the user node 1105C, determines that the user 1130C has entered the first area 1107, according to some embodiments. As stated above, the flow of the user 1130C through the ingress point 1122 may be determined based on further information.

In the illustrated example, both the users 1130C, 1130D have entered the first area 1107, and neither of them leaves the first area 1107 before the other has exited. Based on the tracked interactions, which may be uploaded to the cloud 203 by the ingress points 1140, 1142 or by other nodes of the wireless tracking system, the wireless tracking system determines that both the users 1130C, 1130D have occupied the first area 1107 at the same time. If this condition violates a protocol or triggers an event specific to the environment 1100, the wireless tracking system may issue alerts, take further actions based on the detected violation or event, communicate with an alarm system, communicate with a client device, or take other actions, accordingly. Simply based on interactions with the ingress point, the approximate locations (e.g., the locations of the users 1130C, 1130D are restricted to the first area 1107) of the users may be determined by the wireless tracking system. In an example where the user 1130D has been exposed to a contagious disease, the wireless tracking system may determine that the user 1130C has been potentially exposed, as well, based on both of the users 1130C, 1130D occupying the first area 1107. The wireless tracking system may issue an alert to a client device of the user 1130C or to a building administrator that notifies the user 1130C be tested at a nearby medical facility for the contagious disease, in this case.

Further actions by the wireless tracking system includes issuing instructions to access control systems associated with the ingress points 1120, 1122. The access control system may control locks or gates that are part of the ingress points 1120, 1122. In the above example where the user 1130D has been exposed to a contagious disease, the wireless tracking system may issue instructions to the access control system to lock the doors at the ingress points 1120, 1122 until the contagious individual has been identified and quarantined. In other examples, the ingress node 1122 may be used to check whether an individual is authorized to access a restricted area, in this case the second area 1108. The ingress node 1122 may receive the identifier for the user node 1105D and determine that the user 1130D is unauthorized for access to the second area 1108. The ingress node 1122 may then instruct the access control system to lock the door at ingress point 1122 to prevent entry for the user 1130D. Similarly, the ingress points 1120, 1122 may be restricted, in response to detecting events in the tracked interactions of the user nodes, ingress nodes, and building nodes. Thus, traffic flow of people through the environment 1100 can be controlled and altered based on information from the tracked interactions. For example, if the wireless tracking system detects a number of users traveling through the first area 1107 that is higher than a threshold number, the wireless tracking system may issue instructions (e.g., to security or building administration, to shut down entrances to the first area 1107 or divert traffic away from the first area 1107.

In each the above examples of FIGS. 6A, 11B, and 11C, the building nodes 226, the machine node 1110, and the ingress nodes 1140, 1142 may each be a stationary node having a fixed location that is known by the wireless tracking system (e.g., the location may be stored in the database 244 of the cloud 203 or on a memory of the respective stationary node). Thus, by detecting interactions with a stationary node, the wireless tracking system may determine the location of a user node 228, based on the known location of the stationary node. In some embodiments, the wireless tracking system may assign GPS coordinates that correspond to the stationary node to the user node 228 at the time of the interaction.

In applications that involve contact tracing, a user may report their health conditions or other conditions relevant to the user manually using an app on a client device (e.g., a smart phone app on the user's smart phone). The app may then report the conditions to the wireless tracking system which tracks the interactions of the user through a user node 228 carried by the user. For example, the user may report their body temperature using the app, and the wireless tracking system may use the reported information to determine if the user is potentially carrying a contagious disease.

In some cases, an area of the environment 1100 may be geofenced for disabling tracking in the area. For instance, the second area 1108 may be an area geofenced for disabling tracking. When the wireless nodes (e.g., the user nodes 1105A-D) are in the second area 1108, the wireless nodes may disable their interaction tracking, in response. This may be beneficial for applications that require privacy. For example, patient privacy policies in hospital settings may be the basis for limiting the tracking of interactions between wireless nodes in areas such as the second area 1108. In further embodiments, the tracking of interactions for a wireless node may be disabled in response to detecting that the wireless node has passed through the ingress point 1122 into the second area 1108.

Figure 12:
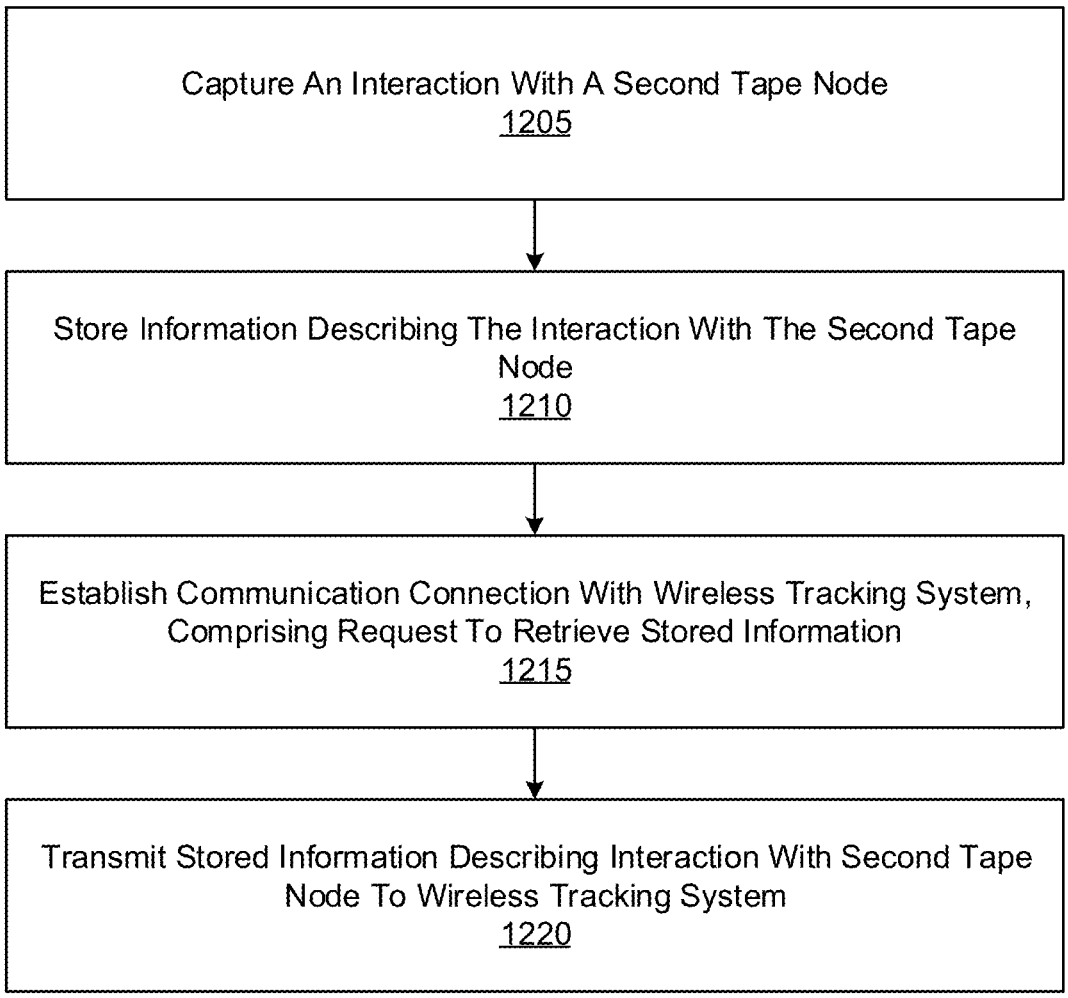
FIG. 12 is a flow diagram of a method of capturing interactions by wireless tape nodes, in accordance with some embodiments.

In some embodiments, statistical analysis of the tracked interactions between wireless nodes may be used to detect events in an environment. For example, FIG. 12 is a flow diagram of a method 1200 of capturing interactions by wireless tape nodes of a wireless tracking system, in accordance with some embodiments. The method includes a first tape node capturing or detecting 1205 an interaction with a second tape node. Interactions between the first tape node and the second node include wireless communications between the first tape node and the second tape node. During the interaction, each tape node may send identifier information for the respective tape node to the other tape node. The first tape node then stores 1210 information describing the interaction with the second tape node in a memory of the first tape node. The first tape node establishes 1215 a communication with the wireless tracking system. The communications may include a request from the wireless tracking system to retrieve the stored information on the interaction. In response, the first tape node transmits 1220 the stored information describing the interaction with the second tape node to the wireless tracking system.

Figure 13:
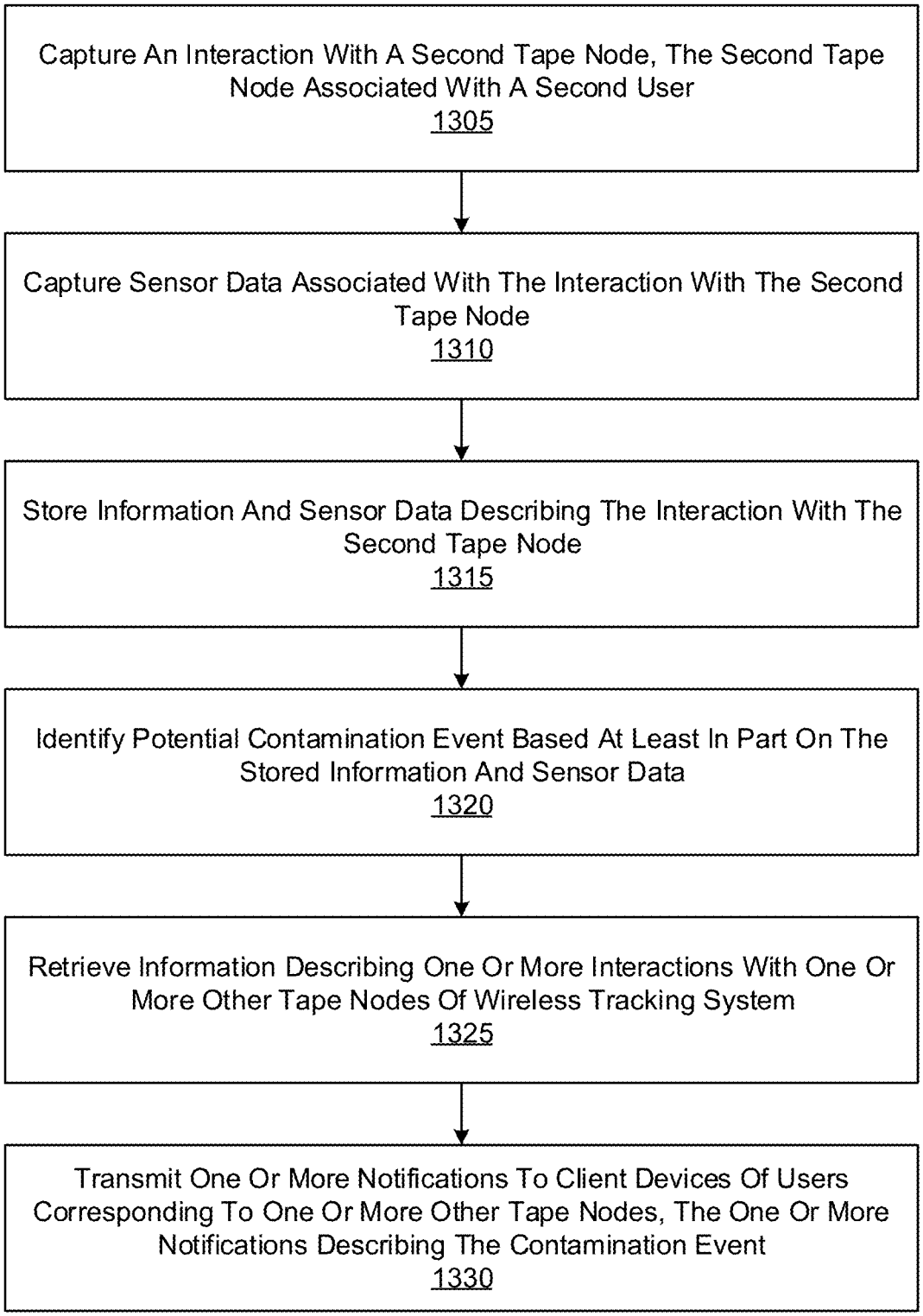

FIG. 13 is a flow diagram of a method 1300 of determining contamination events based on sensor data captured by wireless tape nodes, in accordance with some embodiments. The method 1300 includes a first tape node capturing or detecting 1305 an interaction with a second tape node, the second tape node associated with a second user. The first tape node then captures 1310 sensor data, in association with the interaction with the second tape node. In some embodiments, the sensor data is captured by sensors integrated with the first tape node. The first tape node stores 1315 information describing the interaction with the second tape node and the sensor data in a memory of the first tape node. Based at least in part on the stored information and sensor data, the first tape node identifies 1320 potential contamination events that have occurred in the environment of the first tape node and the second tape node. The first tape retrieves 1325 information describing one or more interactions with one or more other tape nodes of the wireless tracking system that the first tape node has had. The first tape node transmits 1330 one or more notifications to client devices of users that correspond to the on or more other tape nodes. The one or more notifications describe the contamination event.

Figure 14:
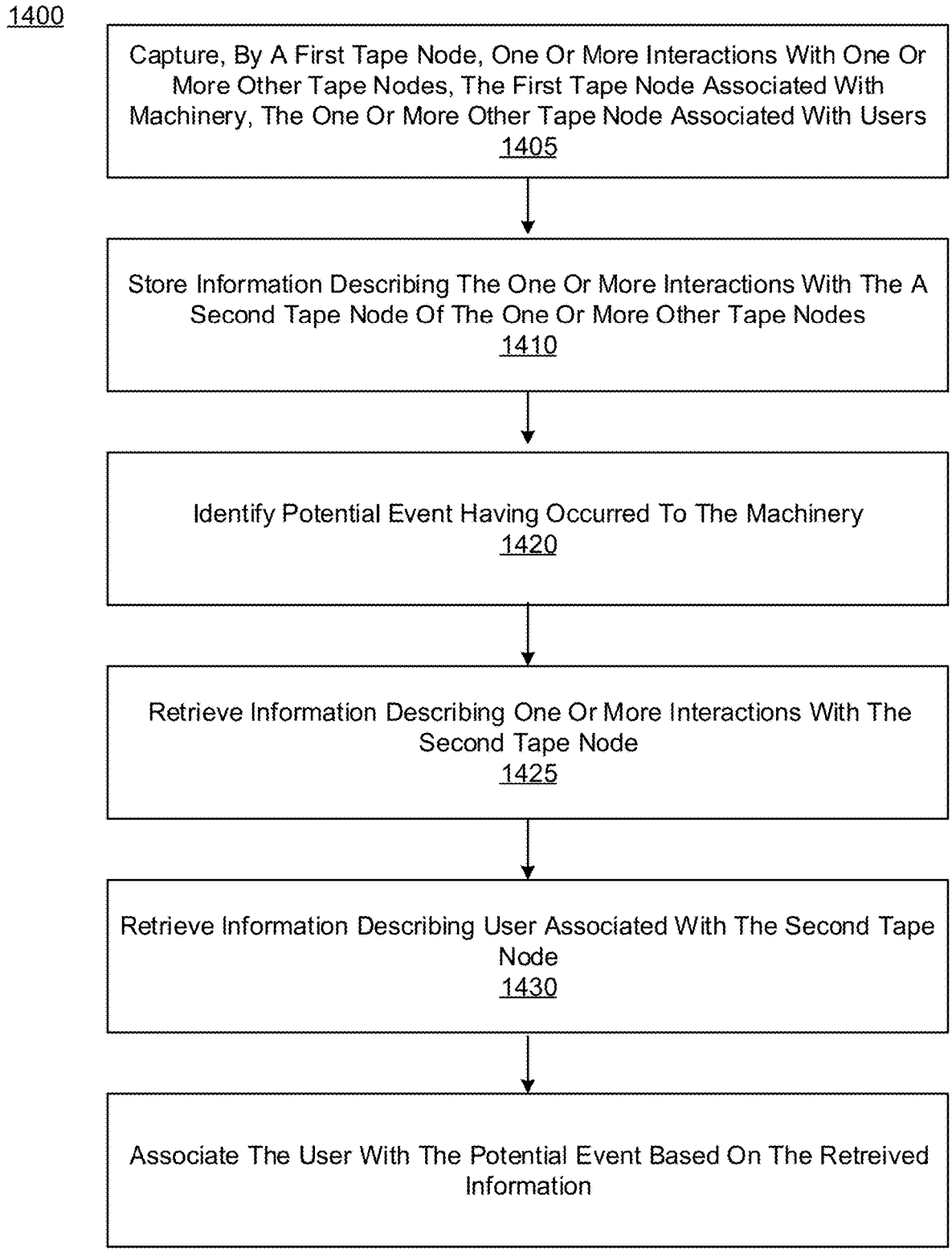
FIG. 14 is a flow diagram of a method of retrieving interactions with machinery responsive to an event occurring in a wireless tracking system, in accordance with some embodiments.

FIG. 14 is a flow diagram of a method of retrieving interactions with machinery responsive to an event occurring in a wireless tracking system, in accordance with some embodiments. The method 1400 includes a first tape node capturing 1405 one or more interaction with one or more other tape nodes. The first tape node is associated with a machinery (i.e., a machine), and the one or more other tape nodes are each associated with a user. The first tape node then stores 1410 information describing the interactions with a second tape node of the one or more other tape nodes. The first tape node identifies 1420 a potential event that has occurred to the machinery. For example, the potential event may be a malfunctioning or failure of the machine. In response to the identifying the potential event, the first tape node retrieves 1425 information describing the one or more interactions with the second tape node and also retrieves 1430 information on a user associated with the second tape node. Based on the retrieved information, the first tape node associates 1635 the user with the potential event. For example, if the retrieved information includes a timestamp of an interaction that took place at a time near the time of the potential event, the first tape node determines that the user may be associated with the potential event. In some cases, the user may be identified as a cause of the event. For example, in the case of a malfunction, the first tape node may determine that the user was operating the machine at the time of the malfunction. The first tape node may upload the association to the cloud 203, according to some embodiments.

Figure 15:
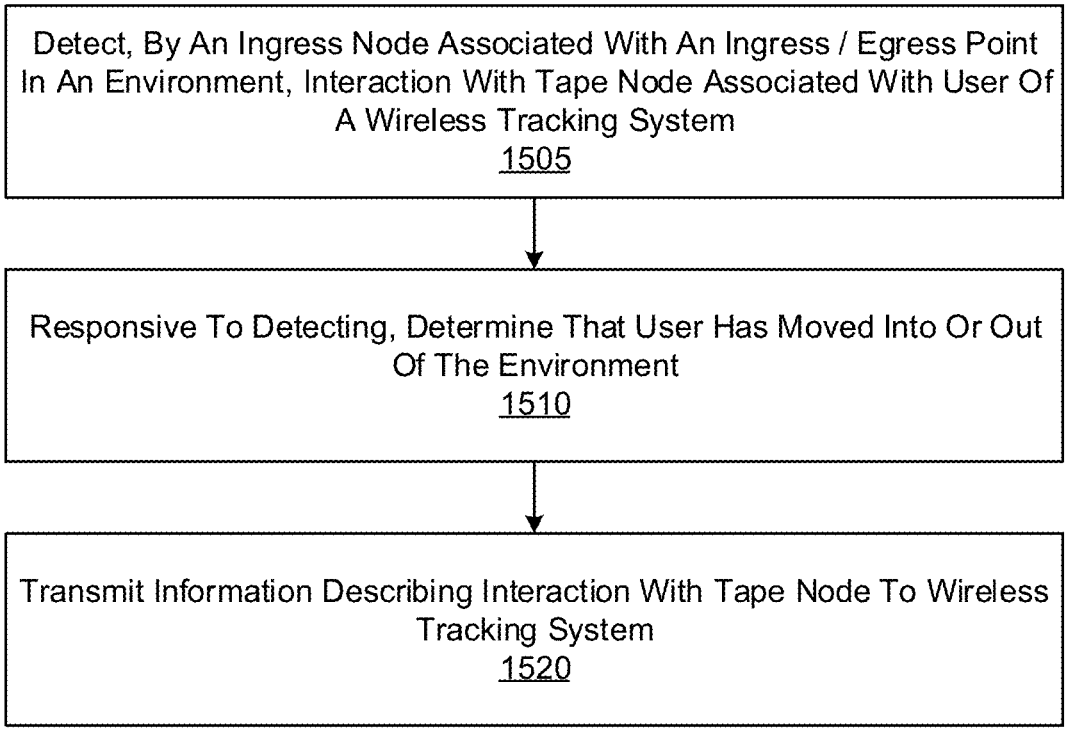
FIG. 15 is a flow diagram of a method of detecting flow of traffic through environments using wireless tape nodes in a wireless tracking system, in accordance with some embodiments.

FIG. 15 is a flow diagram of a method 1500 of detecting flow of traffic through environments using wireless tape nodes in a wireless tracking system, in accordance with some embodiments. The method includes an ingress node associated with an ingress/egress point in an environment detecting 1505 an interaction with a tape node associated with a user of the wireless tracking system. In response, the ingress node determines 1510 that the user has moved into or out of the environment, based on the interaction. For example, based on wireless communications with the tape node, the ingress node may determine an approximate location of the tape node at different times. Based on the determined locations, the ingress node determines if the user has moved into or out of the environment. The ingress node transmits the information describing the interaction and the determined movement to the wireless tracking system 1520 (e.g., to the cloud).

In the above examples discussed with respect to FIGS. 12-15, a tape node may instead be a different type of wireless node. For example, the tape node instead may be a wireless tracking device that does not have a flexible adhesive tape platform form-factor. In other examples, the tape node may instead by a smart badge like the one shown in FIG. 10C or a wearable device like the one shown in FIG. 10D. Also, the example methods of FIGS. 12-15 may include additional or alternate steps not shown in FIGS. 12-15.

In some embodiments, the wireless tracking system issues or raises an alarm in response to detecting that an event or a protocol violation has occurred. For example, if social distancing requirements for users to stay 6 feet or more apart in an area is violated, an alert may be issued to users and wireless nodes of the wireless tracking system. The alarm may include a physical alarm that is present in the environment. For example, the area may include an alarm light notification system that flashes a red light in the event of a protocol violation. Similarly, a machine may have an operational status indicator, e.g., that shines green light for a good status and red light for a bad or malfunctioning status. In the event of a violation protocol, the operational status indicator may flash red lights to warn users of the violation protocol, according to some embodiments.

Interactions Between User Nodes and Security Badges

In some embodiments a user carries both a user node 228 and a security badge for accessing restricted parts of an environment. The restricted parts may include areas, rooms, locations, equipment, tools, machinery, or any other part of an environment where access is restricted. The security badge may have a communication system for communicating with a security system in the environment. The communication system may include an RFID communication system, a near-field communication system (NFC), or some other communication system. In the examples of RFID or NFC, the communication system may be a passive system or circuit that does not require a battery or power supply. More specifically, the RFID or NFC system may be a circuit that can be read by a respective RFID or NFC reader. The user node 228 may be an embodiment of the wireless tape node 1000, the smart badge 1001, or the wearable device 1002.

Figure 16:
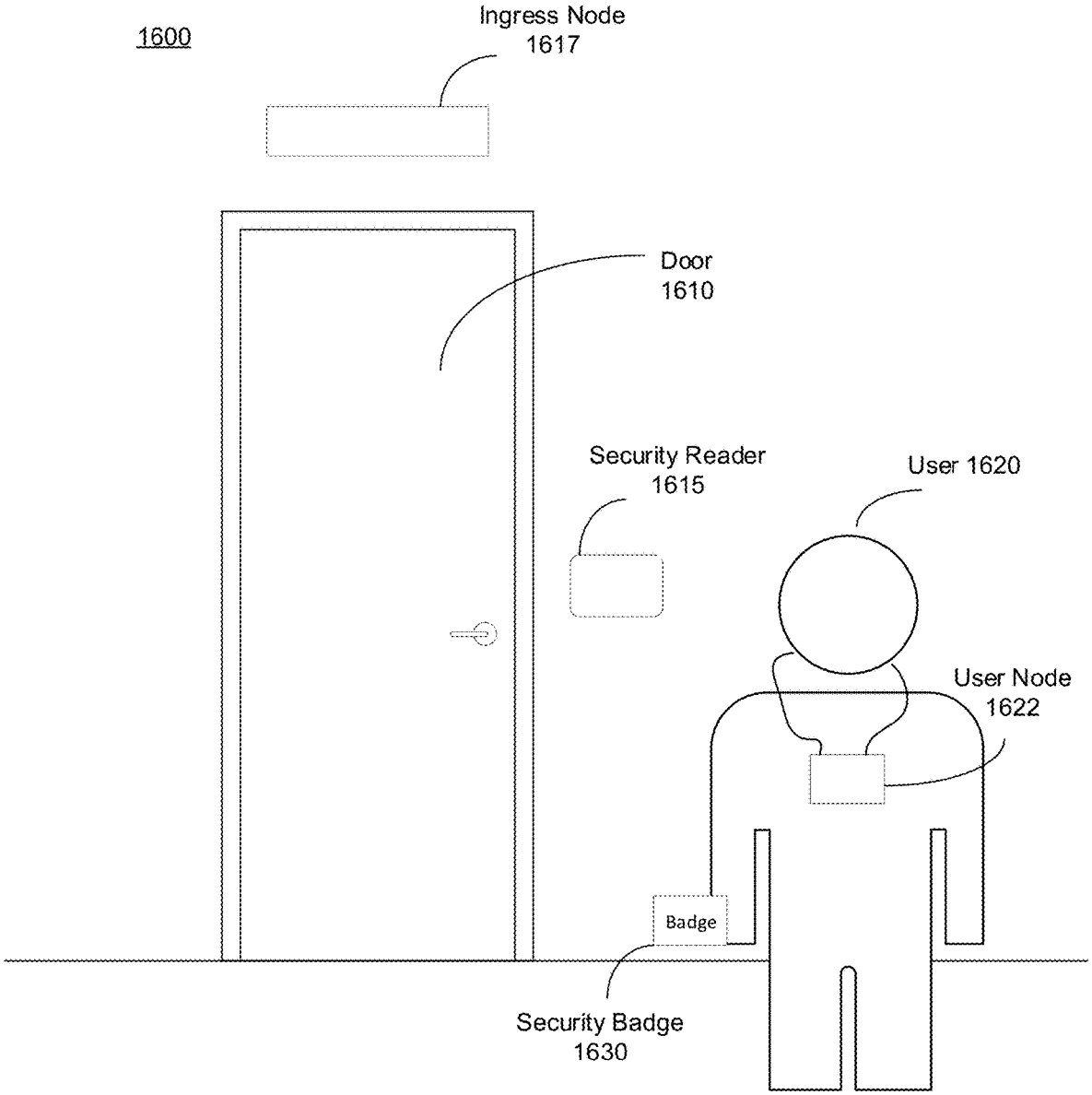
FIG. 16 shows an example environment for an interaction between a user node and the security badge, according to some embodiments.

FIG. 16 shows an example environment 1600 for an interaction between a user node 1622 and the security badge 1630, according to some embodiments. In the example environment, a restricted area is locked behind a door 1610 that includes a security reader 1615 and an associated ingress node 1617. The ingress node 1617 is an embodiment of an ingress node 238 or ingress nodes 1140, 1142, according to some embodiments. The user node 1622 is an embodiment of a user node 228, according to some embodiments. Further, the user node 1622 and the ingress node 1617 may also be embodiments of the wireless tape node 1000.

In order to access the restricted area, a user 1620 must scan their security badge 1630 with the security reader 1615. The security reader 1615 and the security badge 1630 may operate by using RFID or NFC to communicate an identifier of the security badge 1630 stored on the security badge 1630 (e.g., encoded into its RFID or NFC communication system) to an access control system associated with the security reader 1615, according to some embodiments. In other embodiments, other methods are used to communicate between the security badge 1630 and the security reader 1615 for authenticating the security badge. If the identifier of the security badge 1630 is authorized for access to the restricted area, the door 1610 will unlock and allow entry of the user 1620 into the restricted area.

The ingress node 1617 may additionally be used to authenticate the user 1620. For example, in response to the security reader 1615 scanning the security badge 1630, the ingress node 1617 interacts with the user node 1622, and both the user node 1622 and the ingress node 1617 record the interaction, in their respective memories. The ingress node 1617 may access a database (stored on its memory or in the cloud 203) that includes a log of all user node identifiers associated with users that are authorized to enter the restricted area. If it is determined that the user node 1622 and the user 1620 are authorized, based on the tracked interaction, in addition to the security reader successfully authenticating the security badge 1630, the door 1610 unlocks, as described above. However, if the user node 1622 and the user 1620 are not authorized for entry, the door 1610 remains locked even if the security reader 1615 successfully authenticates the security badge 1630. Additionally, the wireless tracking system may issue alerts or raise an alarm in the environment, according to some embodiments.

In some embodiments, the user node 1622 is not associated with an identifier of a user 1620 before an initialization process. In one example, the initialization process is the first time the user node 1622 interacts with the ingress node 1617 at the same time the user 1620 scans their security badge 1630 with the security reader 1615. This may correspond to the first time a user 1620 attempts to enter the restricted area while carrying the user node 1622. The ingress node 1617 determines, based on wireless communication with the user node 1622, that the user node 1622 has not been initialized yet. The ingress node 1617 receives a user node identifier from the user node 1622. Further, the ingress node 1617 may determine the user node 1622 is uninitialized based on determining that no user identifier (e.g., an employee ID number) is associated with the received user node identifier. The ingress node 1617 then begins the initialization process by retrieving a user identifier for the user 1620 from the access control system associated with the security reader 1615. The access control system receives the user identifier from the security reader 1615 when the security badge reads the user identifier stored on the security badge 1630. The ingress node 1617 associates the user node identifier with the user identifier and stores the association in its memory.

The ingress node 1617 may also transmit the association not the user node 1622 for storage in the user node's 1622 memory, according to some embodiments. The ingress nodes 1617 also uploads the association to the cloud 203 of the wireless tracking system, to update the system with the information on the initialized user node 1622. In this embodiment, the wireless tracking system automatically initializes the user node 1622, without a manual procedure by the user 1620, saving the user and any building administrators time and effort.

In some embodiments, the user node 1622 may be reused for a different user at a later time. For example, the user 1620 may return only the user node 1622 to a human operator or collection point. At this time the returned user node 1622 is restored to an uninitialized state. The returned user node 1622 may have its association with the user identifier of the user 1620 deleted from its memory. Additionally, in response to the return of the user node 1622, the wireless tracking system may update its database 244 to delete the association. The wireless tracking system may also delete the association from any other wireless nodes that are storing the association in their respective memories. When a new user is provided with the user node 1622 for reuse, the user node 1622 receives and uninitialized user node 1622 and may initialize it using the new user's security badge, as described above.

Computer Apparatus

Figure 17:
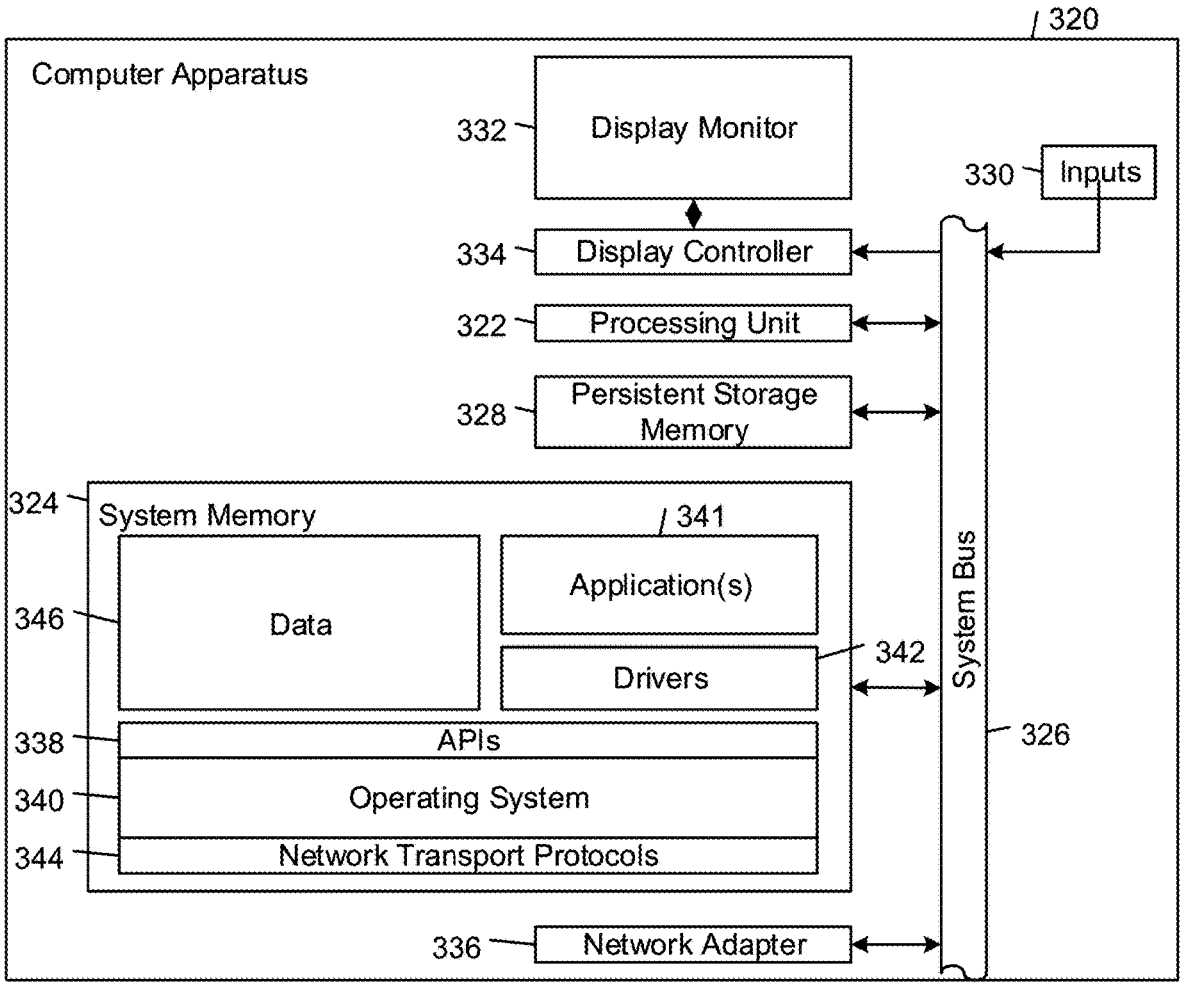
FIG. 17 is a block diagram of an example computer apparatus, according to some embodiments.

FIG. 17 shows an example embodiment of computer apparatus 320 that, either alone or in combination with one or more other computing apparatus, is operable to implement one or more of the computer systems described in this specification.

The computer apparatus 320 includes a processing unit 322, a system memory 324, and a system bus 326 that couples the processing unit 322 to the various components of the computer apparatus 320. The processing unit 322 may include one or more data processors, each of which may be in the form of any one of various commercially available computer processors. The system memory 324 includes one or more computer-readable media that typically are associated with a software application addressing space that defines the addresses that are available to software applications. The system memory 324 may include a read only memory (ROM) that stores a basic input/output system (BIOS) that contains start-up routines for the computer apparatus 320, and a random-access memory (RAM). The system bus 326 may be a memory bus, a peripheral bus or a local bus, and may be compatible with any of a variety of bus protocols, including PCI, VESA, Microchannel, ISA, and EISA. The computer apparatus 320 also includes a persistent storage memory 328 (e.g., a hard drive, a floppy drive, a CD ROM drive, magnetic tape drives, flash memory devices, and digital video disks) that is connected to the system bus 326 and contains one or more computer-readable media disks that provide non-volatile or persistent storage for data, data structures and computer-executable instructions.

A user may interact (e.g., input commands or data) with the computer apparatus 320 using one or more input devices 330 (e.g., one or more keyboards, computer mice, microphones, cameras, joysticks, physical motion sensors, and touch pads). Information may be presented through a graphical user interface (GUI) that is presented to the user on a display monitor 332, which is controlled by a display controller 334. The computer apparatus 320 also may include other input/output hardware (e.g., peripheral output devices, such as speakers and a printer). The computer apparatus 320 connects to other network nodes through a network adapter 336 (also referred to as a "network interface card" or NIC).

A number of program modules may be stored in the system memory 324, including application programming interfaces 338 (APIs), an operating system (OS) 340 (e.g., the Windows® operating system available from Microsoft Corporation of Redmond, Wash. U.S.A.), software applications 341 including one or more software applications programming the computer apparatus 320 to perform one or more of the steps, tasks, operations, or processes of the locationing and/or tracking systems described herein, drivers 342 (e.g., a GUI driver), network transport protocols 344, and data 346 (e.g., input data, output data, program data, a registry, and configuration settings).

Examples of the subject matter described herein, including the disclosed systems, methods, processes, functional operations, and logic flows, can be implemented in data processing apparatus (e.g., computer hardware and digital electronic circuitry) operable to perform functions by operating on input and generating output. Examples of the subject matter described herein also can be tangibly embodied in software or firmware, as one or more sets of computer instructions encoded on one or more tangible non-transitory carrier media (e.g., a machine-readable storage device, substrate, or sequential access memory device) for execution by data processing apparatus.

The details of specific implementations described herein may be specific to particular embodiments of particular inventions and should not be construed as limitations on the scope of any claimed invention. For example, features that are described in connection with separate embodiments may also be incorporated into a single embodiment, and features that are described in connection with a single embodiment may also be implemented in multiple separate embodiments. In addition, the disclosure of steps, tasks, operations, or processes being performed in a particular order does not necessarily require that those steps, tasks, operations, or processes be performed in the particular order; instead, in some cases, one or more of the disclosed steps, tasks, operations, and processes may be performed in a different order or in accordance with a multi-tasking schedule or in parallel.

Other embodiments are within the scope of the claims.

Additional Configuration Information

The foregoing description of the embodiments of the disclosure have been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

capturing, by a tape node of a wireless tracking system, an interaction with a second tape node, the interaction meeting one or more specified conditions and associated with a timestamp;

storing, by the tape node, information describing the interaction with the second tape node;

at a later time, establishing, by the tape node with an entity of the wireless tracking system, a communication connection, the communication connection comprising a request to retrieve one or more sets of stored information; and responsive to the request, transmitting, by the tape node, the stored information describing the interaction with the second tape node to the wireless tracking system.

2. The method of claim 1, wherein the one or more specified conditions includes the interaction with the second tape node being more than a threshold length of time.

3. The method of claim 1, wherein the one or more specified conditions includes the second tape node being within a threshold distance of the tape node.

4. The method of claim 1, wherein capturing an interaction with the second tape node further comprises capturing sensor data during the interaction and storing the captured sensor data in association with the information describing the interaction with the second tape node.

5. The method of claim 4, wherein the captured sensor data is one or more of: a temperature reading; audio or acoustic data; image data; location data; vibration data; electromagnetic data; infrared data; and signal strength data.

6. The method of claim 4, further comprising determining, by the tape node based at least in part on the captured sensor data, a potential contamination event.

7. The method of claim 6, wherein the wireless tracking system is configured to, responsive to receiving captured sensor data corresponding to a potential contamination event, transmit one or more notifications to other users of the wireless tracking system, the one or more notifications comprising at least a notification to a user associated with the second tape node, the notification describing the potential contamination event.

8. The method of claim 1, wherein establishing a communication connection with an entity of the wireless tracking system comprises entering a communication range of a gateway node of the wireless tracking system.

9. The method of claim 1, wherein establishing a communication connection with an entity of the wireless tracking system comprises transmitting a scheduled update to a cloud or server of the wireless tracking system.

10. The method of claim 1, wherein the requested one or more sets of stored information correspond to timestamps within a specified time period.

11. The method of claim 1, wherein the tape node is associated with a first user of the wireless tracking system and the second tape node is associated with a second user of the wireless tracking system.

12. The method of claim 1, wherein the tape node is associated with a first user of the wireless tape node and the second tape node is associated with a first machine of an environment of the wireless tracking system.

13. The method of claim 12, wherein the one or more specified conditions includes the first machine of the environment of the wireless tracking system being powered on during a time interval of the interaction.

14. The method of claim 12, further comprising:

accessing, by the tape node, permissions information describing whether the first user is associated with permission to operate the first machine; and responsive to determining that the first user is associated with permission to operate the first machine, enabling the first machine to power on.

15. The method of claim 1, wherein the tape node is associated with a first user of the wireless tracking system and the second tape node is associated with an ingress or egress point of an environment of the wireless tracking system.

16. A wireless tracking system comprising:

a plurality of tape nodes, each tape node of the plurality of tape nodes comprising one or more communication systems and associated with a user of the wireless tracking system, each tape node of the plurality of tape nodes configured to perform steps comprising:

capturing interactions with other tape nodes of the plurality of tape nodes, the interactions meeting one or more specified conditions and associated with a timestamp;

storing information describing the interaction;

at a later time, establishing a communication connection with an entity of the wireless tracking system; and responsive to establishing the communication connection, transmitting stored information describing one or more interactions with other tape nodes of the plurality of tape nodes to the entity of the wireless tracking system; and one or more gateway nodes, each gateway node of the one or more gateway nodes comprising at least a compatible communication system for communicating with each of the plurality of tape nodes, wherein the one or more gateway nodes are configured to perform steps comprising:

determining that a potential contamination event has occurred;

receiving, from a tape node of the wireless tracking system, information describing one or more interactions having occurred within a time period associated with the potential contamination event; and transmitting a notification to each other tape node of the one or more interactions, the notification alerting respective users of the other tape nodes of the potential contamination event.

17. The wireless tracking system of claim 16, wherein each tape node of the plurality of tape nodes is further configured to:

capture sensor data describing movement of the tape node; and responsive to capturing sensor data corresponding to movement by the tape node, initiate an active mode, the active mode comprising transmitting a signal to other tape nodes of the plurality of tape nodes and receiving signals from other tape nodes.

18. The wireless tracking system of claim 16, wherein each tape node of the plurality of tape nodes is further configured to:

capture sensor data describing movement of the tape node; and responsive to capturing sensor data corresponding to lack of movement by the tape node, initiate a sleep mode, the sleep mode comprising transmitting a signal to other tape nodes of the plurality of tape nodes, wherein the tape node in sleep mode does not receive transmissions by other tape nodes.

19. A wireless tracking system comprising:

a plurality of tape nodes, each tape node of the plurality of tape nodes comprising one or more communication systems and associated with a user of the wireless tracking system;

one or more gateway nodes, each gateway node of the one or more gateway nodes comprising at least a compatible communication system for communicating with each of the plurality of tape nodes and associated with a location of an environment of the wireless tracking system, wherein the one or more gateway nodes are configured to perform steps comprising:

detecting, by a gateway node of the one or more gateway nodes, a tape node of the plurality of tape nodes;

responsive to the detecting, determining that a user associated with the detected tape node is entering the environment; and transmitting a notification to the wireless tracking system that the user associated with the detected tape node has entered the environment.

20. The system of claim 17, wherein the one or more gateway nodes are further configured to perform steps comprising:

accessing permissions information for users of the wireless tracking system, the permissions information describing users of the wireless tracking system that are permitted to access one or more locations of the environment;

retrieving permissions information for the user associated with the detected tape node; and responsive to the retrieving, performing one or more actions corresponding to the permissions information.

* * * * *